US006322341B1

(12) United States Patent
Haas

(10) Patent No.: US 6,322,341 B1
(45) Date of Patent: Nov. 27, 2001

(54) FLUID PRESSURE DRIVEN ROTARY ACTUATOR AND METHOD OF OPERATING THE SAME

(75) Inventor: John R. Haas, Houston, TX (US)

(73) Assignee: Johnson Engineering Corp., Webster, TX (US)

( * ) Notice: Subject to any disclaimer, the term of this patent is extended or adjusted under 35 U.S.C. 154(b) by 0 days.

(21) Appl. No.: 09/438,933

(22) Filed: Nov. 12, 1999

Related U.S. Application Data

(60) Provisional application No. 60/158,594, filed on Oct. 8, 1999.

(51) Int. Cl.[7] ..... F03C 2/00
(52) U.S. Cl. ..... 418/249; 418/251
(58) Field of Search ..... 418/249, 251

(56) References Cited

U.S. PATENT DOCUMENTS

| | | | | |
|---|---|---|---|---|
| 952,465 | * | 3/1910 | Nygaard | 418/249 |
| 3,128,679 | | 4/1964 | Trendle . | |
| 3,659,503 | | 5/1972 | Ehluss et al. | 92/125 |
| 4,506,590 | | 3/1985 | Miki et al. | 91/35 |
| 5,267,504 | | 12/1993 | Weyer | 92/31 |
| 5,332,236 | | 7/1994 | Kastuhara et al. | 277/165 |
| 5,440,970 | | 8/1995 | Tonsor | 92/121 |
| 5,671,652 | | 9/1997 | Weyer | 92/33 |

FOREIGN PATENT DOCUMENTS

| | | | | |
|---|---|---|---|---|
| 2500075 | * | 8/1982 | (FR) | 418/249 |

* cited by examiner

*Primary Examiner*—F. Daniel Lopez
(74) *Attorney, Agent, or Firm*—Rossi & Associates

(57) ABSTRACT

A hydraulic rotary actuator assembly includes a rotatable drive assembly disposed about and rotatable about a longitudinal axis of the actuator and a stator assembly disposed about the rotatable drive assembly. The rotatable drive assembly includes an output shaft having a coupling end for rotatably engaging a workpiece, and a rotor disposed concentrically about the longitudinal axis and rotatable to drive rotation of the output shaft. The rotor has an outside radial surface that includes at least one radially protruding flange or rotor vane. The stator assembly is disposed concentrically about and generally radially spaced from the rotor and has at least one radially movable stator vane that is sealingly engageable with the outside radial surface of the rotor. Sealing engagement between the stator vane and the outside concentric surface forms at least a first pressure cavity and a second pressure cavity, such that first and second pressure cavities are sealingly bounded by at least the rotor vane the and stator vane. Further, a fluid pressure system is provided in fluid communication with the first and second pressure cavities to produce a differential pressure acting on one side of the rotor vane, thereby rotatably moving the output shaft assembly. Each of the stator vanes is radially movable responsive to a variable control element such as a variable pressure cavity. The variable control element is operable by a stator vane control system (e.g, a system including one or more solenoid valves and pressure fluid accumulator) to change the radial position of the vanes relative to the stator and in synchronization with the rotation of the rotor. Accordingly, the rotor assembly of the actuator is continuously movable or rotatable in one direction relative to the stator assembly beyond 360 degrees and without significant pause or change of direction.

36 Claims, 28 Drawing Sheets

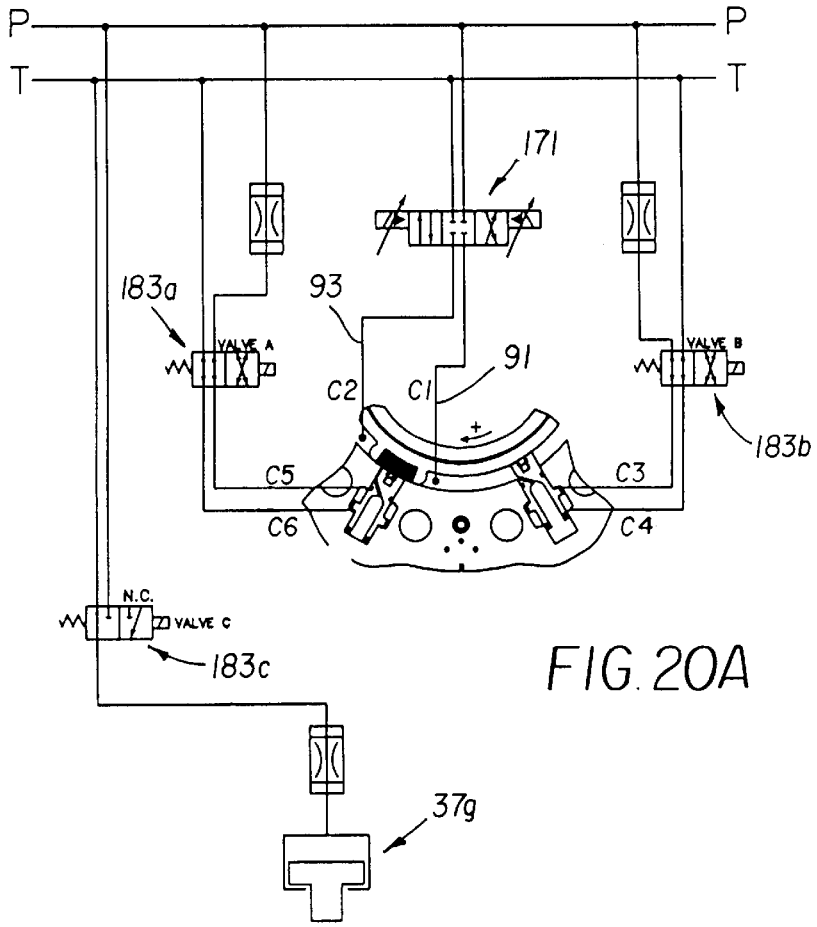
FIG. 20A
FIG. 20B
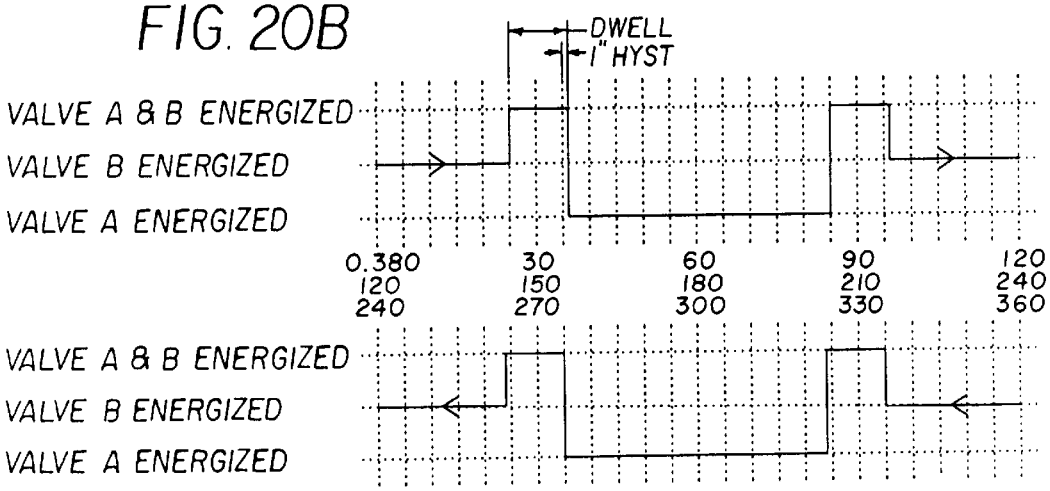

FLUID PRESSURE DRIVEN ROTARY ACTUATOR AND METHOD OF OPERATING THE SAME

The present application claims benefit of the filing date of pending provisional Application Ser. No. 60/158,594 filed on Oct. 8, 1999.

STATEMENT REGARDING FEDERALLY SPONSORED RESEARCH

Not Applicable.

BACKGROUND OF THE INVENTION

The present invention relates generally to a rotary actuator and, more particularly, to a fluid-operated or hydraulic rotary actuator for integration into a mechanical component or system.

One field or application wherein the present inventive rotary actuator is particularly adapted is in the design of articulated robots for industrial use. Rotary power transmission equipment such as actuators and motors have been used to provide the primary component of a joint in these articulated robots. Conventional equipment used in these applications include rotary vane actuators, planetary helical rotary actuators, axial vane motors, rack and pinion rotary actuators, radial piston hydraulic motors, and a variety of hydraulic motor driven gear box combinations. In many applications, it is desirable for such equipment to be compact in size, lightweight, responsive, and capable of achieving precision rotary motion control. Since fluid-powered (e.g., hydraulic) rotary actuators may be designed to feature physical and operational attributes which are consistent with these desirable aspects, such actuators are often preferred to electric motors.

SUMMARY OF THE INVENTION

It is one of a several objects of the invention to provide an improved rotary actuator having one or more desirable features or capabilities.

It is another object of the invention to provide an improved fluid-powered rotary actuator.

It is yet another object of the invention to provide an improved hydraulic rotary actuator, such as one particularly adapted for integration into a joint of an articulated robot.

It will be shown that a rotary actuator of the present invention may be particularly useful in applications where a rotary actuator or low speed, high torque hydraulic motor is currently used. Further, certain embodiments of the inventive actuator are particularly appropriate for use in new and existing applications wherein precision rotary motion control and/or weight or volume constraints are critical. Applications include use in robotic manipulators and remotely operated systems provided in environments not particularly suitable for human occupancy. Embodiments of the present invention may provide, among other attributes, high torque and load capacity with respect to weight, an ability to tolerate harsh environments, reliability and improved response to control system input. It will also be shown that the rotary actuator design described herein lends itself to utilization of corrosion resistant materials in a water tight configuration.

In one aspect of the invention, a rotary actuator assembly is provided having a rotatable drive assembly characterized by a longitudinal axis. The drive assembly includes an output shaft having a coupling end for rotatably engaging a workpiece, and a rotor disposed concentrically about the longitudinal axis and rotatable in a designated angular direction to drive rotation of the output shaft. The rotor has a rotor radial surface that includes at least one (preferably a plurality) radially extending rotor vane. The actuator also has a stator assembly with a stator radial surface having at least one (preferably a plurality) radially extending stator vane. This stator assembly is disposed about the longitudinal axis such that the rotor and the stator are aligned or positioned to form a pressure chamber defined, at least partially, by the separation between the stator radial surfaces. Thus, the rotor vane is substantially sealingly engageable with the stator radial surface and the stator vane is substantially sealingly engageable with the rotor radial surface to form at least a first pressure cavity of the pressure chamber and a second pressure cavity of the pressure chamber. These pressure cavities are bounded, at least partially, by a rotor vane, a stator vane and the radial surfaces of the stator and rotor. The second pressure cavity is disposed adjacent the rotor vane in the designated angular direction and the second pressure cavity is disposed adjacent the rotor vane in the opposite angular direction.

The actuator may further include a fluid pressure circuit disposed in fluid communication with the first and second pressure cavities to produce a differential pressure acting on the rotor vane thereby rotatably moving the output shaft assembly in the angular direction. In such an actuator, the rotor assembly is substantially continuously rotatable up to and/or beyond about 360 degrees relative to the stator assembly. Alternatively, the rotor may be continuously rotatable relative to the stator assembly through a plurality of cycles.

One rotary actuator described herein is a rotor-stator vane type hydraulic rotary actuator featuring continuous rotation capabilities and stator vane operation that is synchronized with rotation of the rotor. In one aspect of the present invention, the actuator provides continuous rotation beyond 360 degrees. Such an actuator is particularly advantageous for use in powering the joints of a man-rated, underwater robotic manipulator system. For example, the inventive actuator may be used in a trainer/simulator that mimics a space station facility remote manipulator system and which may be provided in an underwater training facility. In conjunction with a servo hydraulic control system, such an actuator provides smooth, continuous rotary motion, while acting against externally applied torsional, bending, shear and axial loads. Preferably, the actuator is rotatable through a plurality of cycles.

Alternatively, a hydraulic rotary actuator assembly according to the invention has a rotatable drive assembly with a longitudinal axis and a stator assembly. The rotatable drive assembly includes an output shaft having a coupling end for rotatably engaging a workpiece, and a rotor disposed concentrically about the longitudinal axis and rotatable to drive rotation of the output shaft. Further, the rotor has an outside radial surface that includes at least one radially extending flange or rotor vane. The stator assembly is disposed concentrically about the rotor and has at least one radially movable stator vane that is sealingly engageable with the outside radial surface of the rotor throughout angular movement (e.g., rotation through a plurality of cycles) of the rotor. Sealing engagement between the stator vane and the outside radial surface forms at least a first pressure cavity and a second pressure cavity, wherein the first and second pressure cavities are sealingly bounded by at least the rotor vane and the stator vane.

Further, a fluid pressure system may be provided in fluid communication with the first and second pressure cavities to produce a differential pressure acting on one side of the rotor vane, thereby rotatably moving the output shaft assembly. In one aspect of the invention, the rotor assembly of the actuator is continuously movable or rotatable in one direction relative to the stator assembly (i.e., continuously beyond 360 degrees without pause or change of direction). Each of the stator vanes are disposed adjacent and is movably responsive to a variable control element such as a variable pressure cavity or force transmitting mechanical member. The variable control element is operable by a stator vane control circuit system (e.g, a system including one or more solenoid valves and/or pressure fluid accumulator) to change the position of the vanes relative to the stator and in synchronization with the rotation of the rotor. The stator vane control circuit may be operably interconnected (and thus synchronized with) the fluid pressure system. For example, the control circuit may be provided with solenoid operated, multi-port cartridge valves fluidly interconnected to stator pockets retaining the stator vanes, with a servo-hydraulic control system of the fluid pressure system.

Sealing engagement between components may be provided by a seal assembly having an outwardly facing seal material and a seal energizer disposed behind the seal material. Several variations of such a construction are described herein. In several embodiments, a seal assembly having a two-part construction of a seal material and a seal energizer is described. For example, a rotor vane assembly is provided having at least a pair of spaced apart flanges creating a gap therebetween. A seal assembly, including a seal material and an elastomeric seal energizer, is secured within the gap and preferably conforms to an arcuate shape. The seal assembly preferably has a two-part construction, wherein the seal energizer is retained within the seal material (e.g., a through-way or aperture may be formed in the seal material) and acts to energize or bias the seal material outwardly from within the aperture. Moreover, the seal material may have at least four sealing engagement surfaces, one or more of which is provided with a plurality of sealing ridges. The sealing ridges are spaced apart from one another, sealingly engages independently of one another, and are disposed in generally parallel relation.

A seal assembly having most of, if not all, of the features described above, and in accordance with the present invention, provides a simple and effective design. Further, such a seal assembly is particularly well adapted for incorporation into a rotor vane assembly and rotor of a hydraulic rotary actuator also according to the invention. Such a seal assembly promotes and/or enhances one or more of the features and advantages associated with the rotary actuator of the present invention.

In yet another aspect of the invention, a method of rotatably driving an output shaft assembly of a rotary actuator is provided. The method includes the step of providing an actuator assembly having a housing assembly, an output shaft assembly characterized by a longitudinal axis and a coupling end adapted to rotatably engage a workpiece, and a rotor disposed about the longitudinal axis. Further, a rotor is provided that has an outside rotor radial surface and a plurality of rotor vanes radially extending from the radial surface, a stator assembly having an inside stator radial surface and a plurality of radially movable stator vanes.

The method further includes the steps of retaining the stator assembly and the output shaft assembly with the housing assembly, such that the stator assembly is positioned concentrically about the longitudinal axis and the rotor radial surface is spaced from the stator radial surface. In this way, the stator vanes can substantially sealingly engage the rotor radial surface and the rotor vanes substantially sealingly engages either the stator vanes or the stator radial surface, thereby subdividing the pressure chamber into a plurality of pressure cavities. Here, each pressure cavity is bounded, at least partially, by a stator vane, a rotor vane and the radial surfaces of the rotor and the stator assembly, and the pressure cavities vary in volume as the rotor moves angularly forward in the designated angular direction. The inventive method also includes controllably applying fluid pressure to selected pressure cavities so as to produce a differential pressure across the rotor vanes, thereby effecting angular movement of the rotor and the output shaft in the designated angular direction. Also, the stator vanes may be radially moved relative to the rotor, such that the rotor vanes reciprocate radially in synchronization with angular movement of the rotor.

In a variation of the inventive method, the radially moving step includes radially moving each stator vane outwardly away from the longitudinal axis as each rotor vane moves angularly past the stator vane. This method may also include the step of substantially sealingly engaging the stator vane with each rotor vane as each rotor vane moves past the stator vane. In a further variation, the step of radially moving each of the stator vanes inwardly away from the longitudinal axis as each of the rotor vanes moves angularly past the stator vane is performed so as to allow continuous rotation of the rotor and the output shaft beyond 360 degrees relative to the stator assembly.

Other and further objects, features, and advantages of the present invention will be apparent from the description provided herein of presently preferred embodiments of the invention, given for the purpose of disclosure, and taken in conjunction with the accompanying drawings.

BRIEF DESCRIPTION OF THE DRAWINGS

FIGS. 20A–20B are hydraulic schematic and graphic representations of the operation of the elbow actuator;

DETAILED DESCRIPTION OF THE DRAWINGS

FIGS. 1–20 depict a hydraulic rotary actuator 21 embodying the invention. More particularly, the actuator 21 is an elbow actuator 21 (i.e., adapted for an elbow type joint) that is operable with a servo-hydraulic control system and features the combination of continuous rotor rotation capabilities, and a balanced radially-movable stator vane system, the operation of which is synchronized with the rotation of the rotor. The actuator 21 is particularly adapted for powering a joint of a manrated underwater robotic manipulator system. For example, the actuator 21 may be adapted for use in an elbow-type, wrist-type, or shoulder-type robotic joint.

Figure 1A:
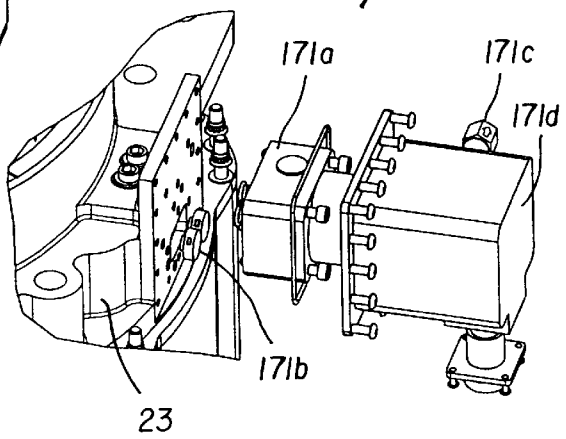
FIG. 1A is an exploded detail view of a servo-hydraulic control system for the elbow actuator in FIG. 1.
Figure 1:
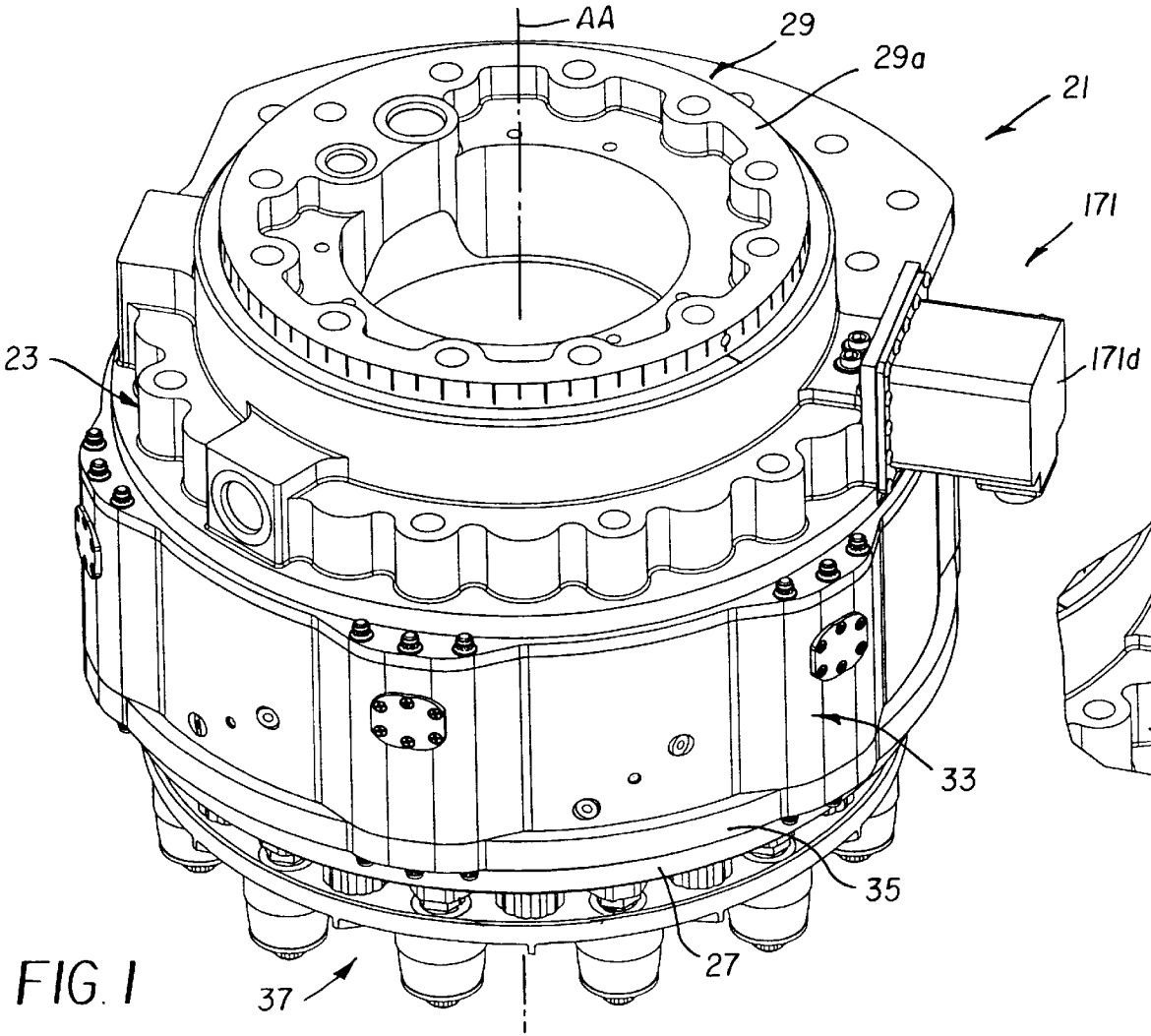
FIG. 1 is a top perspective view of an elbow actuator according to the invention.
Figure 2:
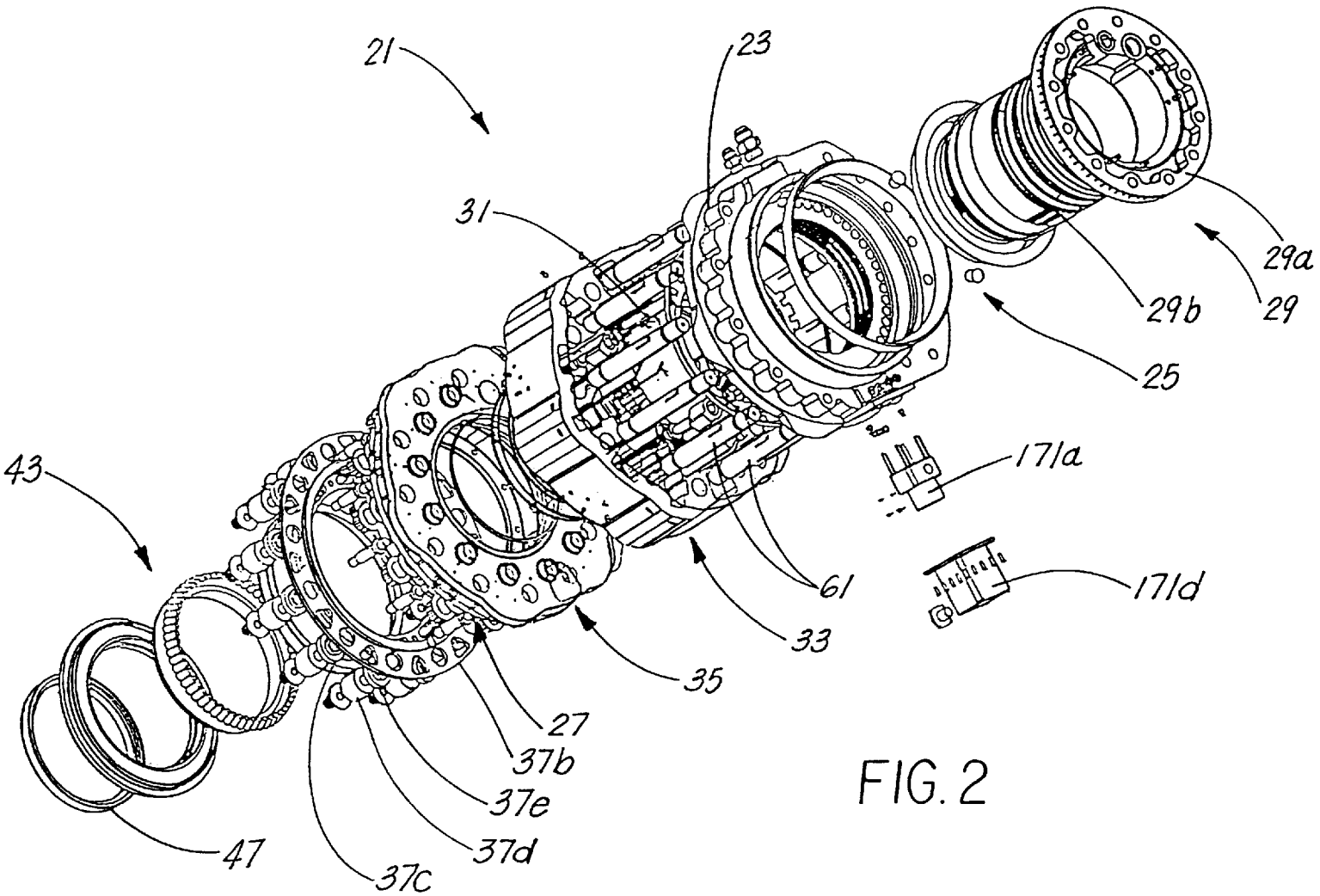
FIG. 2 is an exploded view of the elbow actuator in FIG. 1.

Referring specifically to FIGS. 1 and 2, the actuator 21 according to this embodiment of the invention comprises an assembly of components including a rotatable output assembly and a fixed housing assembly, the sub-components of which are generally centered about a longitudinal axis AA of the actuator 21. The principal components of the fixed housing assembly include an upper end cap assembly 23, a lower end cap assembly 27, a stator assembly 33 secured therebetween, and a brake assembly 37. These components 23, 27, 33, 37 are secured together by, among other means, a plurality of threaded dowels 61 extending through dowel holes provided in each of the components. The principal components of the rotatable output assembly include an output shaft member or output shaft 29 disposed centrally about the longitudinal axis AA and a rotor member or rotor 31 disposed concentrically about the output shaft 29 and rotatable therewith (see also FIG. 4).

The actuator 21 also includes a fluid pressure circuit which will be shown to effect rotation of the output shaft 29 by creating a differential pressure that acts on the rotor 31. The fluid pressure circuit includes a pressure working cavity or chamber 191 formed between the rotor 31 and the stator assembly 33, and fluid passages 91, 93 extending through the upper end cap assembly 23 and output shaft assembly (both discussed below in further detail with respect to FIGS. 3 and 13). Preferably, both fluid passages 91, 93 fluidly communicates with a servo-hydraulic control system 171 having a servo-valve 171*a* (such as a 2 GPM rated valve that is commercially available from Atchley Controls of Utah). Referring to FIG. 1A, the servo-valve is secured to the end cap assembly 23 so as to communicate with the fluid passages 91, 93. The servo-hydraulic control system 171 also includes a pressure transducer 171*b*, a burst disk 171*c*, and a valve cover 171*d*, the operation and function of each is conventional and generally known in the art.

FIGS. 21–27 depict another hydraulic rotary actuator 21' embodying the invention, wherein reference numerals used in FIGS. 1–20 are used in reference to like elements. More particularly, the actuator 21' is a wrist actuator 21 (i.e., adapted for a wrist-type joint) that is operable with a servo-hydraulic control system 171' and features the combination of continuous rotor rotation capabilities and a balanced, radially-movable stator vane system adapted to operate in synchronization with the rotation of the rotor 31'. The actuator 21' is also particularly adapted for powering a joint of a man-rated underwater robotic manipulator system. As is further described below, the wrist actuator 21' has many of the structural and functional features of the elbow actuator 21 of FIGS. 1–20. However, the wrist actuator 21' depicted in the drawings differs primarily in that it utilizes a slave vane that corresponds with a stator vane, to balance the stator vane upon reciprocal radial movement, as further described below.

Referring again to the elbow actuator 21 of FIGS. 1–20, the rotatable output assembly is generally situated internally of the fixed housing assembly, and is rotatable relative therewith and about the longitudinal axis AA. During rotation of the rotatable output assembly, the rotor 31 engages, and interacts with, the stator assembly 33 in such a manner so as to effect smooth, continuous rotation of the rotor 31 and the output shaft 29 up to and beyond 360 degrees (or through a plurality of cycles). To facilitate description of this embodiment of the invention, the end of the actuator 21 generally occupied by the upper end cap assembly 23 is referred to as the upper longitudinal end or upper end of the actuator 21, while the end of the actuator 21 generally occupied by the lower end cap assembly 27 is referred to as the lower longitudinal end or lower end of the actuator 21.

Figure 3:
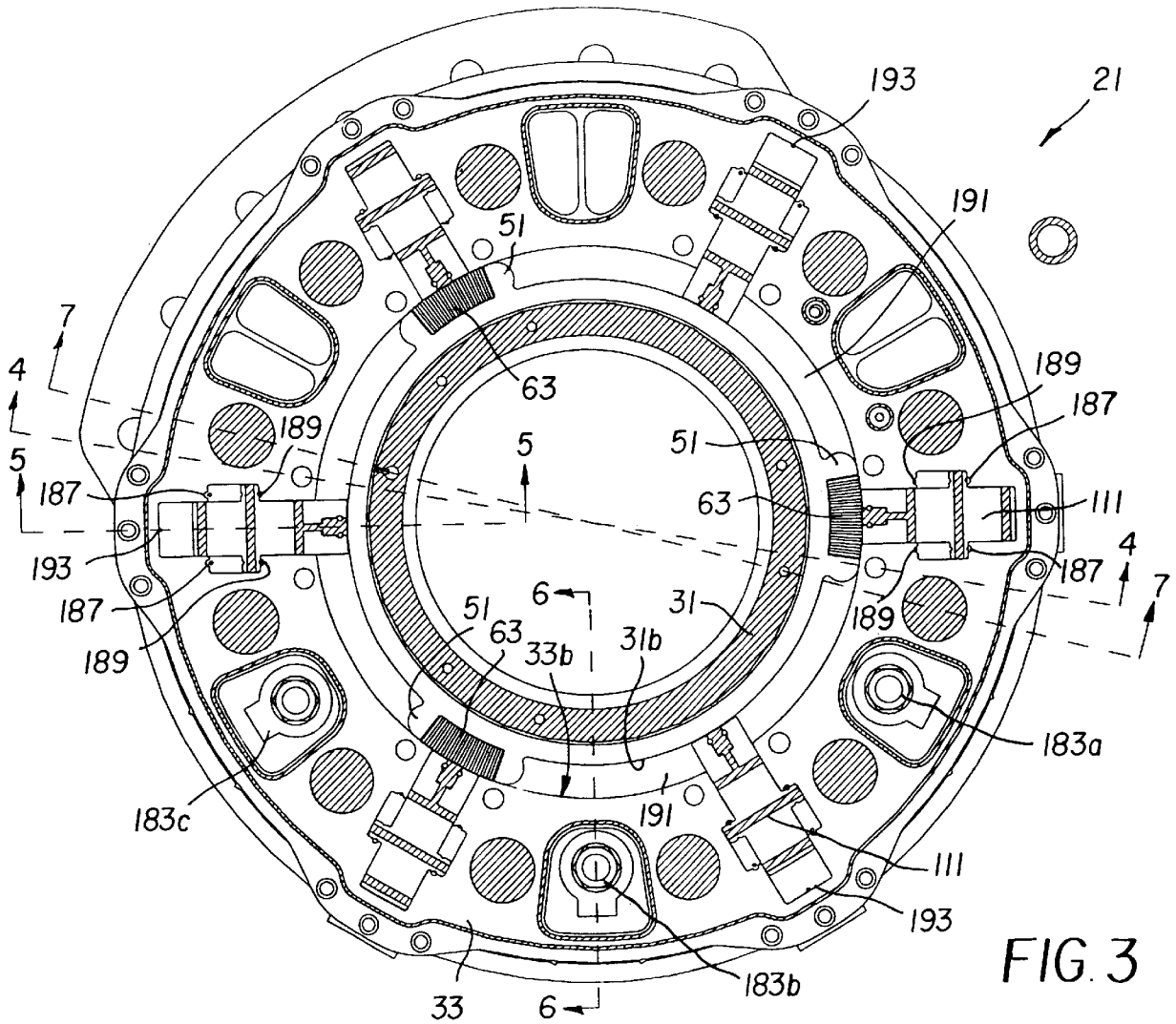
FIG. 3 is a vertical sectional view of the elbow actuator in FIG. 1.

FIG. 3 provides a horizontal cross-sectional view of the actuator 21 at an elevation between the upper end cap assembly 23 and the valve body 35. This view more clearly depicts the sub-components of the stator assembly 33 and the rotor 31. This view also provides reference for FIGS. 4–7 which are vertical cross-sectional views of the actuator 21 in FIG. 3 and further illustrates certain of the various inventive aspects of the actuator 21.

Figure 4:
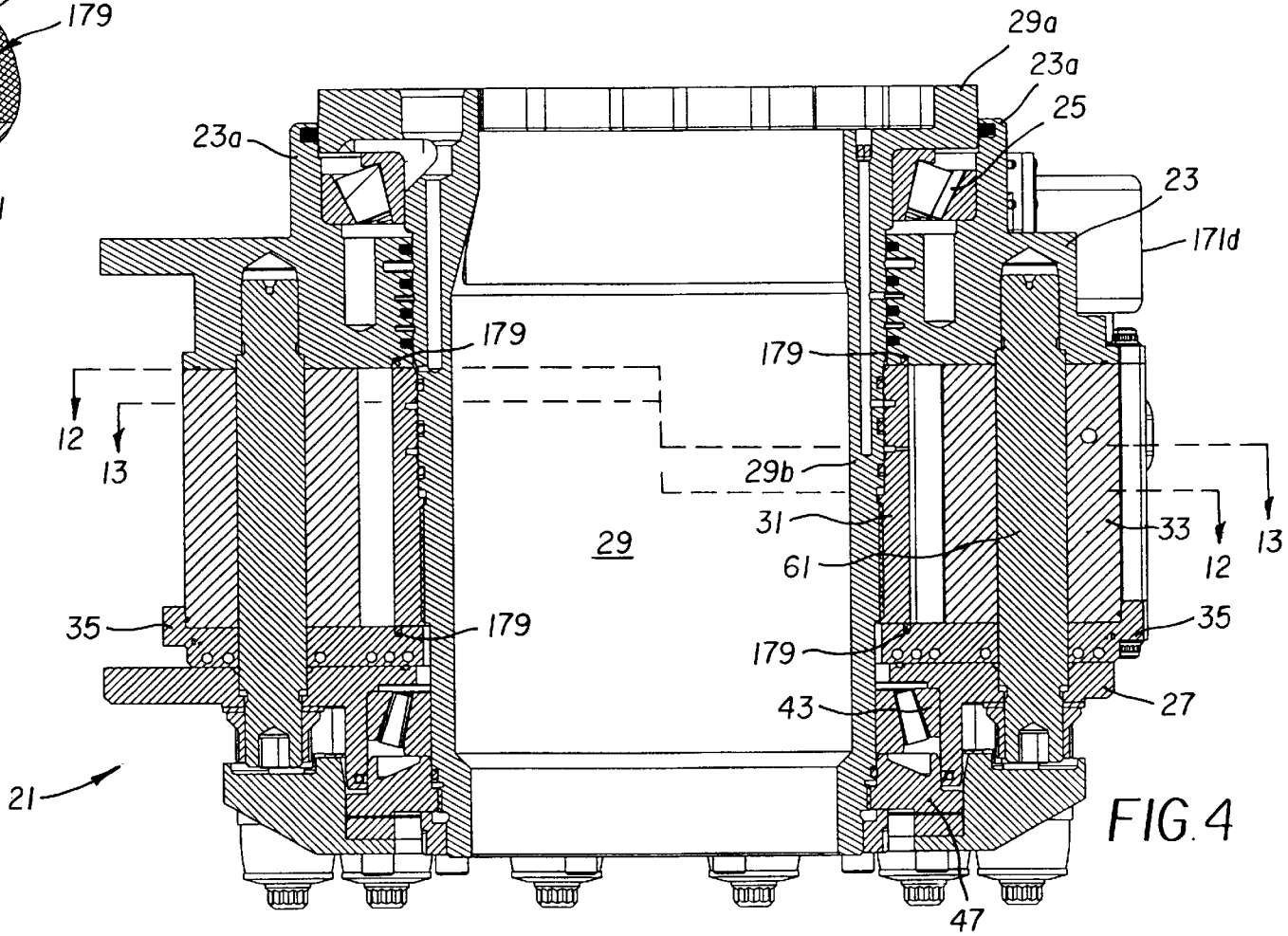
FIG. 4 is a cross-sectional view through line 4—4 of FIG. 3.

Referring to FIG. 4, the output shaft 29 is preferably supported by upper and lower tapered bearing assemblies 25, 43, and is secured in place partially by the upper and lower end cap assemblies 23, 27. Mounted between the end cap assemblies 23, 27, and concentrically about the output shaft 29 are the rotor assembly 31, the stator assembly 33, and a valve manifold or valve body assembly 35. The rotor assembly 31 is configured to fit snugly about the output shaft assembly 29, and to be secured between the upper end cap assembly 27 and the valve body 35. As explained above, multiple dowels 61 are extended through dowel holes in the upper end cap assembly 23, the stator assembly 33, the valve body 35 and the lower end cap assembly 27 to secure these components together as one fixed assembly.

Figure 5:
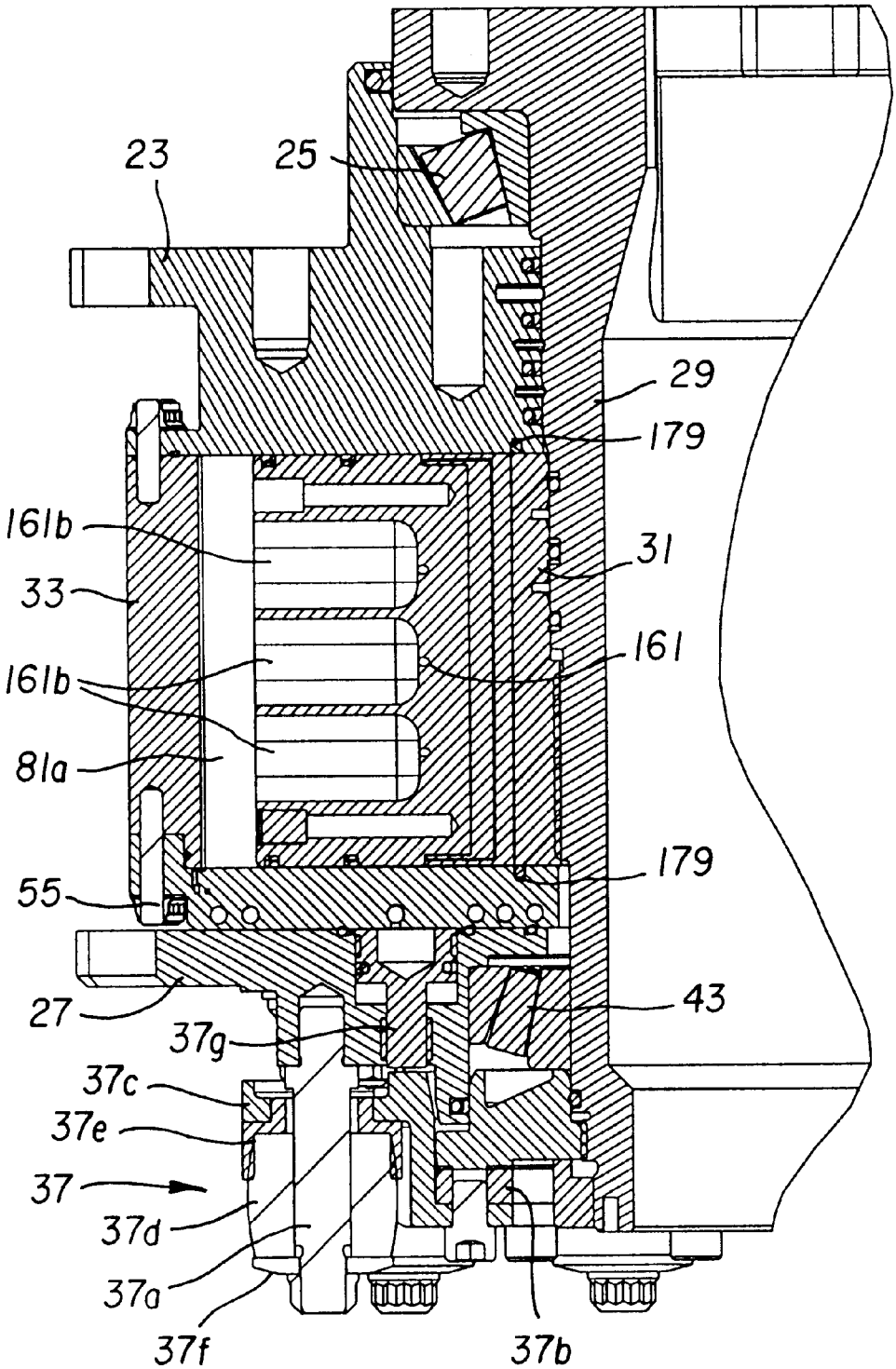
FIG. 5 is a partial vertical sectional view through line 5—5 in FIG. 3.
Figure 6:
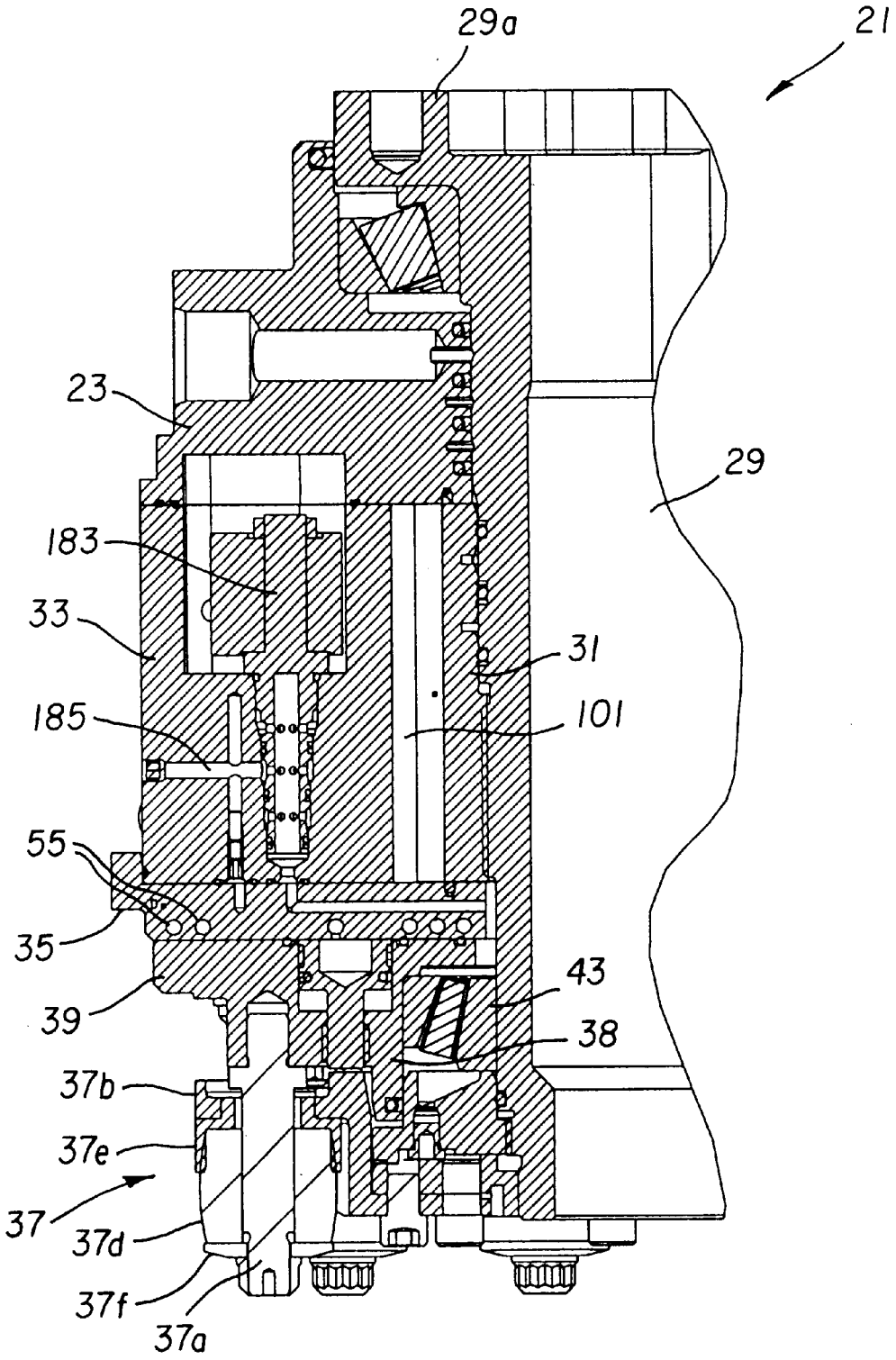
FIG. 6 is a partial vertical sectional view across line 6—6 in FIG. 3.
Figure 7:
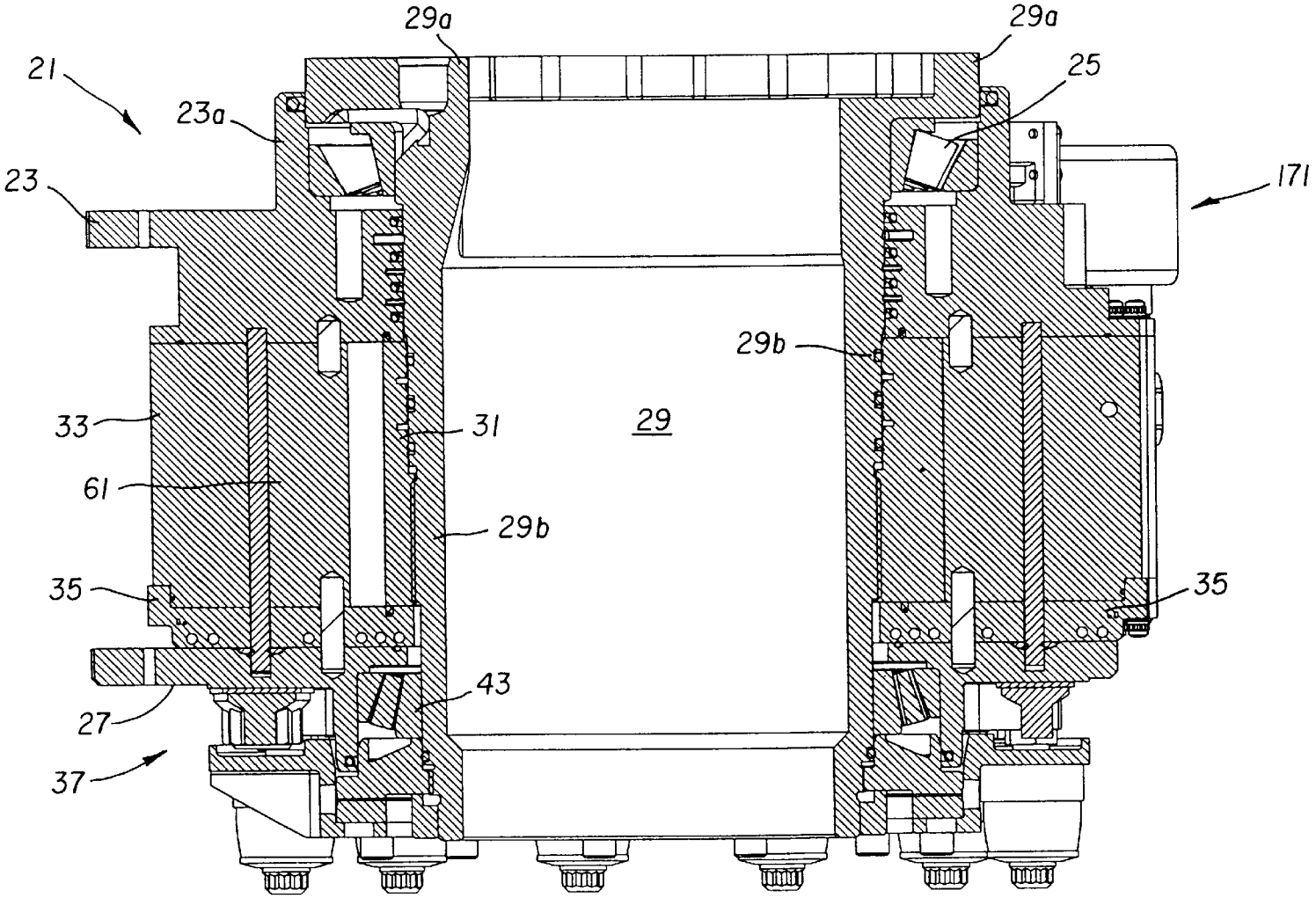
FIG. 7 is a vertical cross-sectional view through line 7—7 in FIG. 3.
Figure 8A:
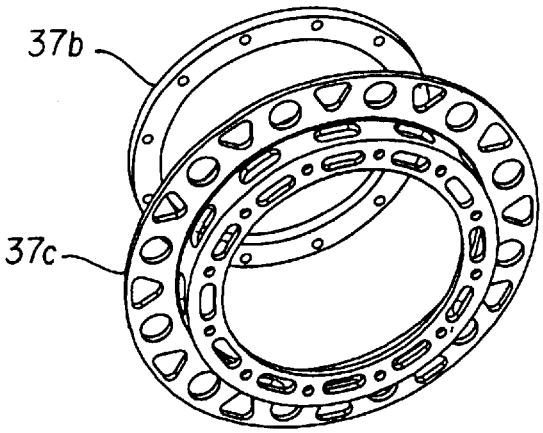
FIGS. 8A–8C are detail views of the component of a brake assembly according to the invention.
Figure 8B:
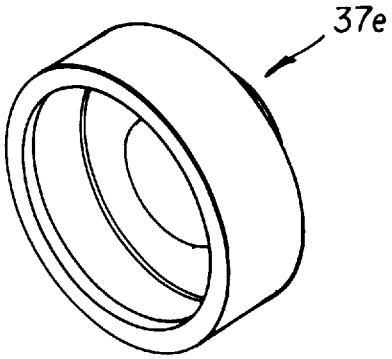
Figure 8C:
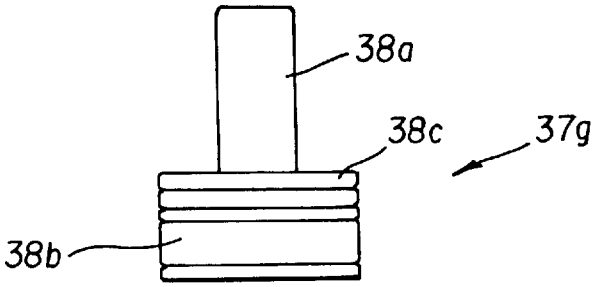

Referring first to FIG. 5, the brake assembly 37 is secured by a plurality of spring studs 37*a* disposed below the lower end cap assembly 27 and about a lower end of the output shaft 29. The brake assembly 37 includes a cylindrical brake stator assembly consisting of a preferably stainless steel, generally "U"-shaped brake 37*b* and a titanium carrier 37*c*, both secured in place by the studs 37*a*. A brake spring 37*d* and a spring cup 37*e* is secured about the studs 37*a* and in between the brake stator assembly 37*b* and a retaining washer 37*f*. This arrangement causes the brake stator assembly 37*b* to be biased upwardly in the direction of the lower end cap assembly 29, and a brake piston assembly 37*g* to be biased upwardly through and above lower end cap assembly 39. FIGS. 8A through 8C provide detailed views of the brake stator assembly, the spring cup 37*e* and a brake piston assembly 37*g*. The brake piston assembly 37*g* is preferably comprised of a piston 38*a*, a wear ring 38*b* disposed about a base portion of the piston 38*b*, and a glide ring seal 38*c* disposed about the shaft portion of the piston 38*a*.

The output shaft 29 is preferably an elongated, titanium (or other suitable steel or material) member with a flanged, coupling end 29*a* that protrudes axially outward at the upper end of the actuator 21 so as to be engageable with a work piece, and an elongated shaft body 29*b* that extends axially downward from the coupling end 29*a*. A top portion 23*a* of the upper end cap assembly 23 is fitted around the coupling end 29*a* to provide a concentric seal around the output shaft 29. As shown in the Figures, the output shaft member 29 is rotatably supported about the upper tapered roller bearing assembly 25 immediately beneath the coupling end 29*a*. The upper bearing assembly 25 is situated between the upper end cap assembly 23 and the shaft body 29*b*. The shaft body 29*b* extends axially downward below the upper bearing assembly 25 and the upper end cap assembly 27, and then through the stator assembly 33. At the lower end of the actuator 21, the output shaft 29 is rotatably supported by the lower tapered roller bearing assembly 43. The lower bearing assembly 43 is supported concentrically by the lower end cap assembly 27 and, below, by a shaft nut 47 disposed about a lower end of the output shaft body 29*b*.

The valve body 35 is generally a plate or disk-shape laminate member, and is preferably secured by the lower end cap assembly 27 adjacent the underside of the stator assembly 33 and the rotor 31. The valve body 35 is disposed concentrically about the shaft body 29*b* and is also provided with dowel holes to accommodate the dowels 61 which secure the fixed housing assembly together. Accordingly, the valve body 35 may also be referred to as a component of the fixed housing assembly.

Figure 9A:
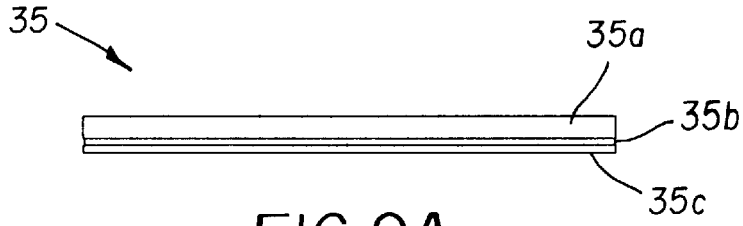
FIGS. 9A–9B are detail views of a valve manifold according to the invention.
Figure 9B:
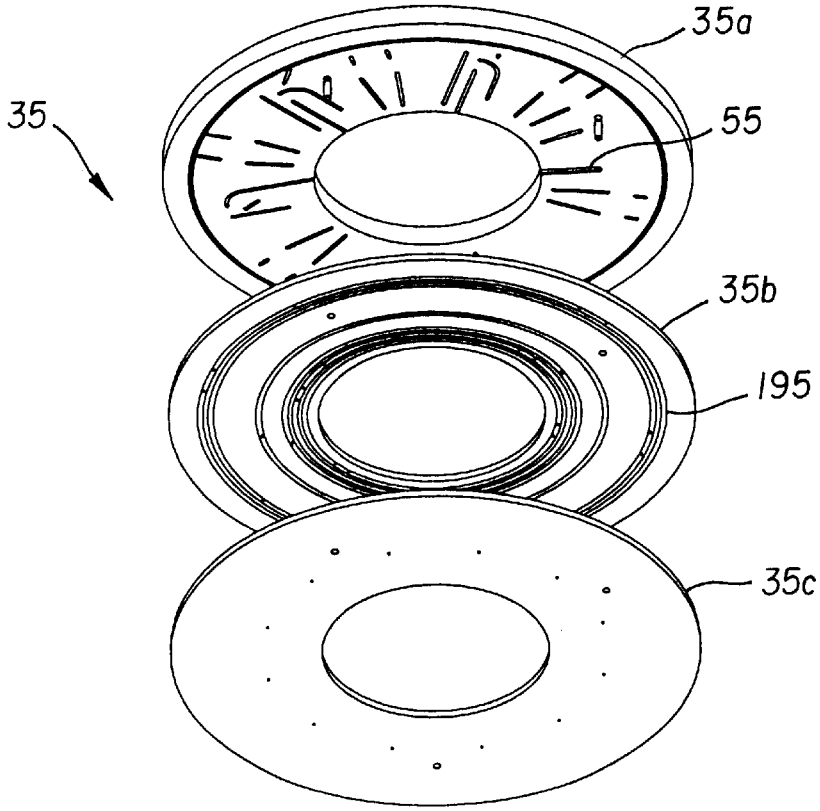

As best shown in the views of FIG. 9, the valve body 35 may comprise of three plates 35*a*, 35*b*, 35*c* which are adapted to be bonded together so as to create an integral portion of one or more fluid-based pressure control systems or circuits. The plates 35*a*, 35*b*, 35*c* are provided with a system of radially extending grooves, circumferential grooves (e.g., circumferential passage groove 195) and vertical holes or apertures, many of which come together to form fluid pressure passages 55 or systems. Some of the passages 55 communicate with and convey fluid into or form pressure cavities in the stator assembly 33 so as to effect movement of stator vane assembly 111 therein (as described in further detail below) (see also FIG. 6). The fluid passages 55 may also be disposed in fluid communication with one or more passages (not shown) provided through the lower end cap assembly 39 so as to communicate with an external pressure source.

For the wrist actuator 21' of FIGS. 21–27, fluid passages 55' are in communication with one or more solenoid valve assemblies 57'. The solenoid valve assemblies 57' are positioned under the lower end cap assemblies 27' for convenience, and are fluidly connected to a common pressure accumulator 59 (see e.g., FIG. 21)'. Solenoid valve assemblies 57' and an accumulator 59' or hydraulic power supply which are suitable for operation with the actuator 21' may be any one of several conventional types which are commercially available. The fluid passages 55', the solenoid valve assemblies 57' and accumulator 59', together with a position sensing and solenoid switching system, provide the principal components of a fluid-based stator control circuit or control system (according to the invention) that is operable to control movement of and, thus, engagement of the stator assembly 33' with the rotor 31'.

As applied in the present invention, a fluid based stator vane control system is used in the wrist actuator 21' and the elbow actuator 21 to synchronize movement and operation of stator vanes 111, 111' of the stator assembly 33, 33' with rotation of the rotor 31, 31', so as to provide for smooth, continuous rotation of the rotor 31, 31' up to and beyond 360 degrees. In one aspect of the invention, the stator vane 111, 111' is retracted radially (away from the rotor 31, 31') as rotor vanes 51, 51' of the rotor 31 moves angularly past the stator vane 111, 111'. A specific stator control system suitable for this application is further described below as applied to the elbow actuator 21.

However, it is noted that various control systems may be used in lieu of a system employing fluid passages and/or the solenoid valve assemblies such as described above. Moreover, the control system may be hydraulically or pneumatically operated, or be any of a number of mechanical or electro-mechanical systems known in the art. The incorporation of any one of these systems into the actuator of the invention so as to provide control and synchronization of the stator assembly will become apparent to one skilled in the art upon reading the description of and viewing the related drawings provided herein.

Figure 10:
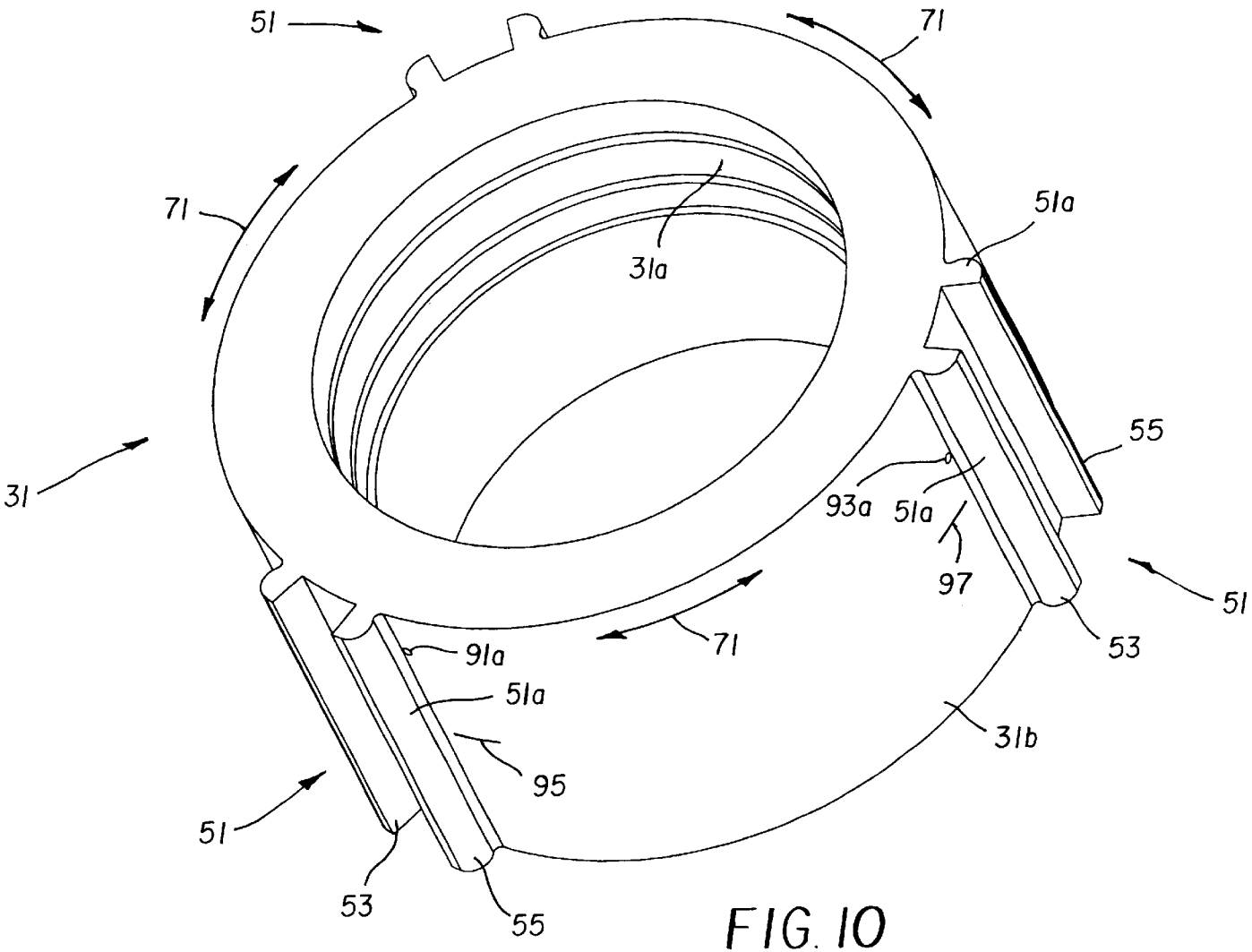
FIG. 10 is a perspective view of a rotor according to the invention.
Figure 11:
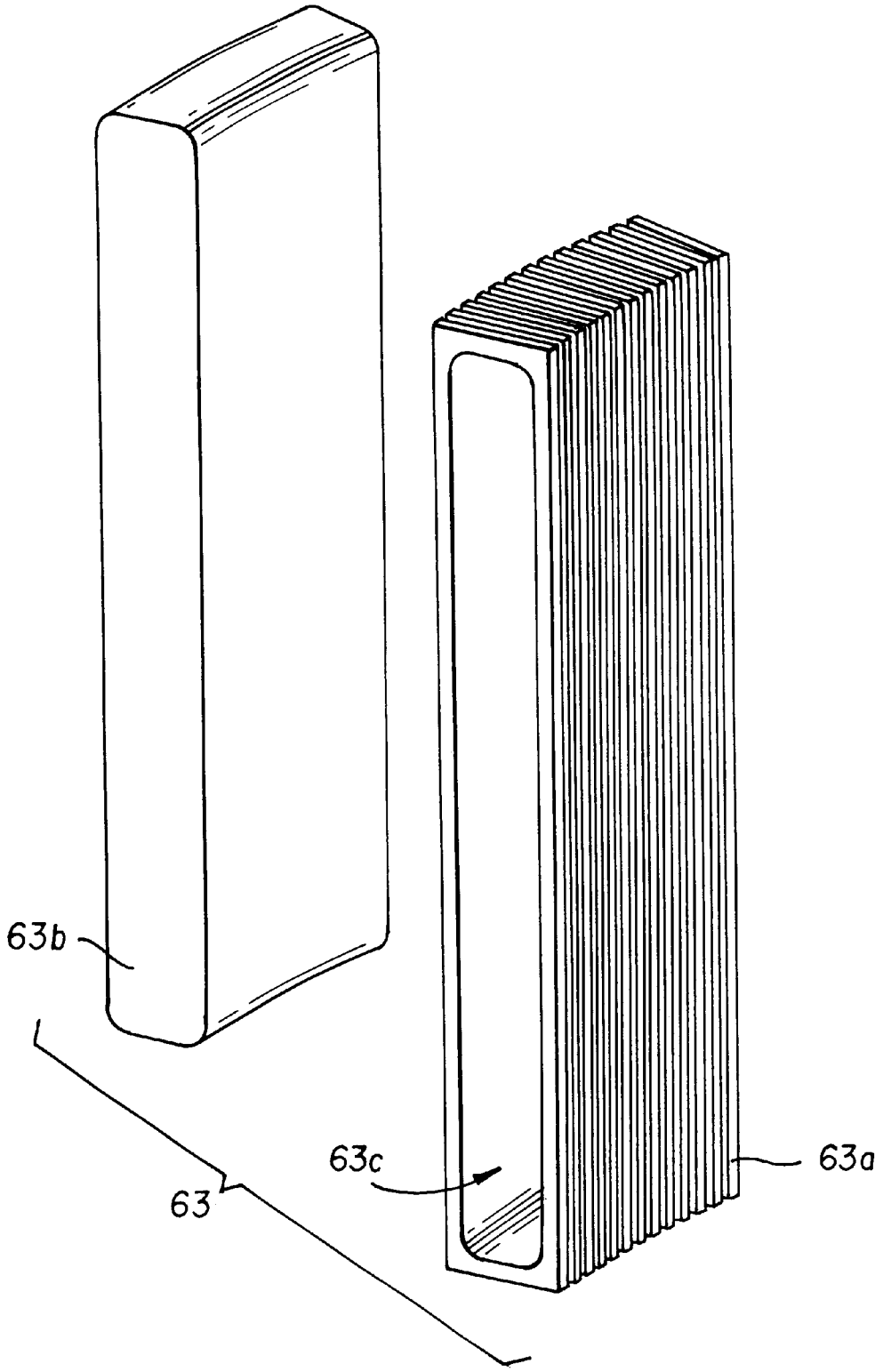
FIG. 11 are detail views of a rotor vane assembly according to the invention.

The rotor 31 is fixed to, and rotatable with, the output shaft 29 (which in turn is rotatably supported by the roller bearings 25, 43), so as to constrain the rotor 31 to one degree of freedom, i.e., rotation about the longitudinal axis AA. FIG. 10 depicts the rotor 31 independently of output shaft 29. The rotor 31 preferably has a generally cylindrical body with an inside radial surface 31*a* securable about the output shaft body 29*b* and an outside radial surface 31*b* facing radially outward toward the stator assembly 33. The outside radial surface 31*b* is generally smooth and circular, except for three sets of vertically extending, radially extending sealing flange assemblies or rotor vanes 51. The rotor vanes 51 may be spaced equally apart, thereby partitioning the outside surface of the rotor 31 into three equally-sized arc segments 71 (i.e., each segment has a span of about 100°).

Referring again to FIG. 3, the rotor vanes 51 extends radially outward to engage the stator assembly 33. The separation between the radial surface 31*b* of the rotor 31 and an inside radial surface 33*b* of the stator assembly 33 partly defines the pressure chamber 191 therebetween. As will be explained below, this chamber 191 is further divided into a plurality of pressure cavities 91 by the rotor vanes 51, stator vane assemblies 111, and the upper end cup assembly 23. Part of the pressure chamber 191 is sealed by metal-to-metal contact between the stator assembly 33 and the upper end cap assembly 23 and the valve body 35.

Figure 4A:
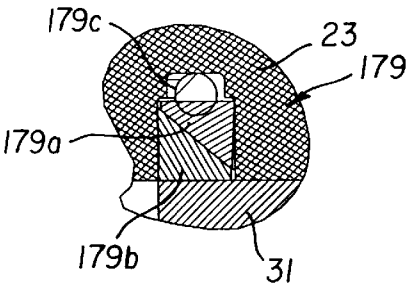
FIG. 4A is a detail of FIG. 4.

Referring to FIGS. 4 and 4A, a fluoroelastomer energized concentric seal assembly or rotor end seal assembly 179 is provided to seal the dynamic interface between the rotor 31 and the upper end cup assembly 23. The seal assembly 179 is secured in a concentric groove on the lower surface of the end cap assembly 23. Further, the seal assembly 23 comprises a first composite seal material 179*a* having a semi-triangular cross section and a second composite seal material 179*b* also having a semi-triangular cross section. A bottom face of the second seal 179*b* engages the surface of rotor 31. As shown in FIG. 3, the two seals 179*a*, 179*b* are secured in the groove so as to mutually engage and form a generally rectangular cross section. A circular seal energizer 179*c* is provided above the first seal 179*a* so as to bias the first seal 179*a* downward. This downward bias is transferred to the second seal 179*b* across the diagonal (in cross section) engagement area between the first and second seals 179*a*, 179*b*, thereby creating both a vertical and horizontal component of the biasing force transferred. A similar seal assembly 179 is provided at the interface of the rotor 31 and the valve body 35. In yet another aspect of the present invention, both seal assemblies 179 are further energized by the system pressure applied adjacent to seal energizers 179*c*.

It should be understood, however, that alternative embodiments of the rotor 31 according to the invention may employ more than three rotor vanes and as few as one rotor vane. Upon reading the description provided and/or viewing the drawings provided herein, it will be apparent to one skilled in the art how to incorporate a design of a rotor having one or a multiple number of rotor vanes into a design of a hydraulic rotary actuator according to the invention.

For present purposes the exemplary rotor 31 (and output shaft 29) is rotatable in the clockwise direction to rotatably drive a work piece interconnected with the coupling end 29*a* of the output shaft 29. In this regard, and with reference specifically to FIG. 10, each rotor vane 51 provides a first vertically extending flange or front flange 53 and a second vertically extending flange or rear flange 55 that is angularly offset in the counter-clockwise direction from the first flange 53. This offset between the pair of flanges 53, 55 creates a gap of predetermined size and shape between the two flanges 53, 55. In an alternative embodiment, the rotor vane 51 may be provided with a central flange disposed between the flanges 53, 55 so as to form two gaps (or alternate configuration).

Each flange 53, 55 has an outer pressure surface or wall 51*a* that is disposed generally normal to the outer radial surface 31*b* of the rotor 31 and has a rounded contour for facilitating relative movement between the rotor vane 51 and the stator assembly 33. In yet another aspect of the invention, each pair of flanges 53, 55 accommodates a vertically elongated fluoroelastomer energized seal assembly 63 (see, e.g., FIG. 3) having a generally arcuate shape. This rotor vane seal 63 is engageable with the stator assembly 33 to define a boundary for two of a plurality of pressure cavities 101 (see e.g. FIG. 6). As will be shown below, pressure cavities 101 provide variable volume and a variable pressure which acts on the pressure surface 51*a* of one of the flanges 53, 55.

Referring to FIG. 1, the inventive seal assembly 63 preferably has a two-part construction consisting of a seal material such as a PTFE composite seal 63*a* and a one-piece seal energizer 63*b* (e.g., viton material). The seal material 63*a* is equipped with a through-way or aperture 63*d* for retaining the seal energizer 63*b*. When installed in the gap between the flanges 53, 55, both the seal material 63*a* and the seal energizer 63*b* conform to a generally arcuate shape. When the pressure chamber 191 is pressurized, the seal energizer 63*b* further acts on and biases the seal material 63*a* outwardly from within the aperture 63*d*. Accordingly, the seal material 63*a* provides four sealing engagement surfaces 63*c* (one each for the upper cap assembly 29, lower cap assembly 27, stator assembly 33 and the back of the rotor vane 51).

Each sealing engagement surface 63*c* is formed from a plurality of spaced apart sealing lines or ridges which are disposed in generally parallel relation. These sealing ridges are particularly adapted to sealing against an irregular and/or moving sealing surface. When the sealing engagement surface 63*c* engages the stator vane assembly 111, for example, multiple seals between sealing engagement surface 63*c* and the stator vane assembly 111 are put into effect at any one time and the sealing engagement surface 63*c* engages the radial surface of the stator vane assembly 111 at multiple sealing locations. The sealing locations move as the rotor vane 51 rotates past the stator vane assembly 111; but, a seal is maintained between the sealing engagement surface 63*c* and the stator vane assembly 111. In a further aspect of the inventive seal design, a one piece seal energizer 63*b* is used to energize the multiple, independent sealing ridges. The seal energizer 63*b* is made particularly advantageous in this application because of its substantially uniform one-piece structure, is how it confirms within the aperture and its structural relation with the configuration of the seal material 63*a*.

Figure 12:
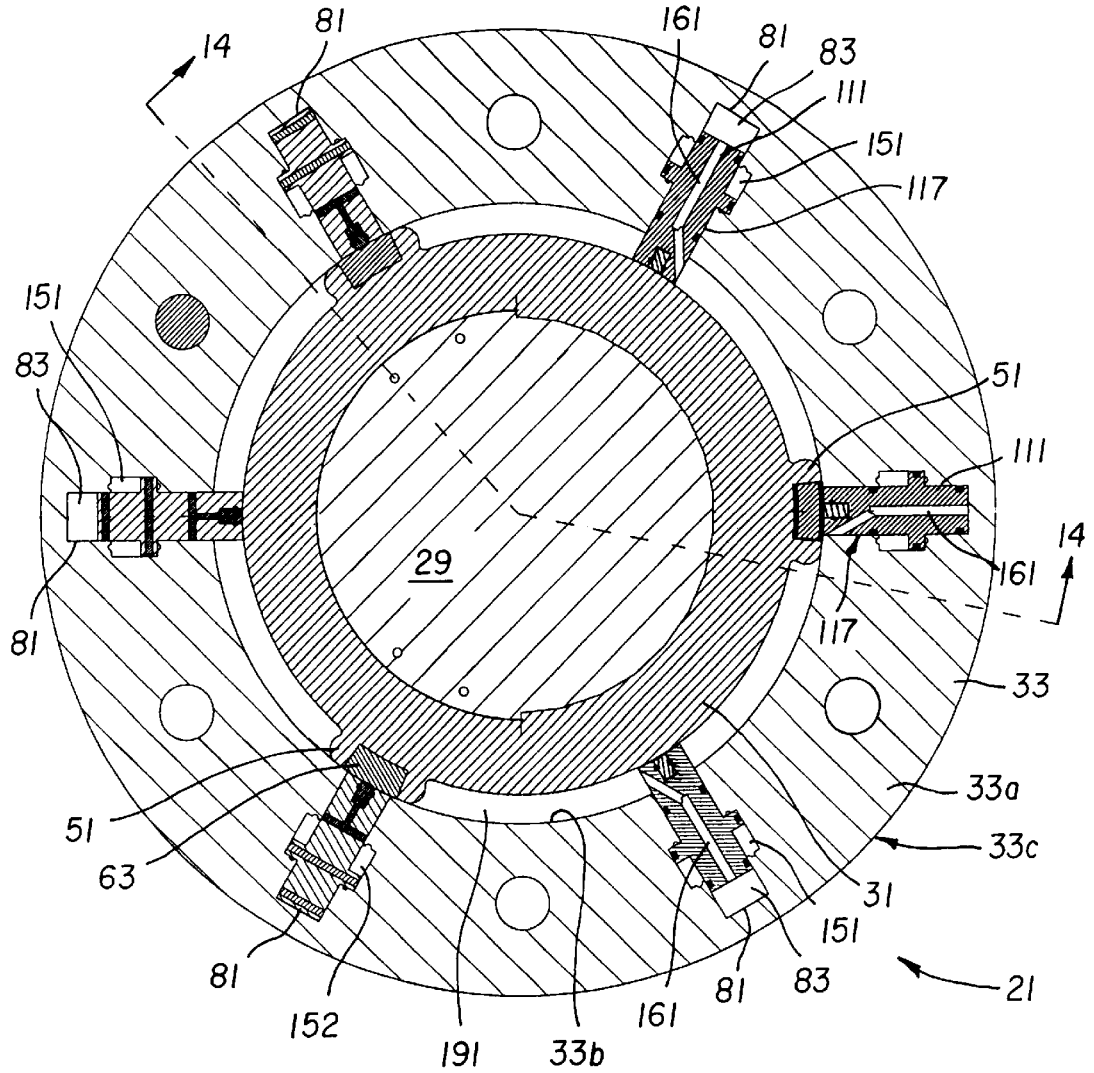
FIG. 12 is a cross-sectional view through line 12—12 in FIG. 4.
Figure 13:
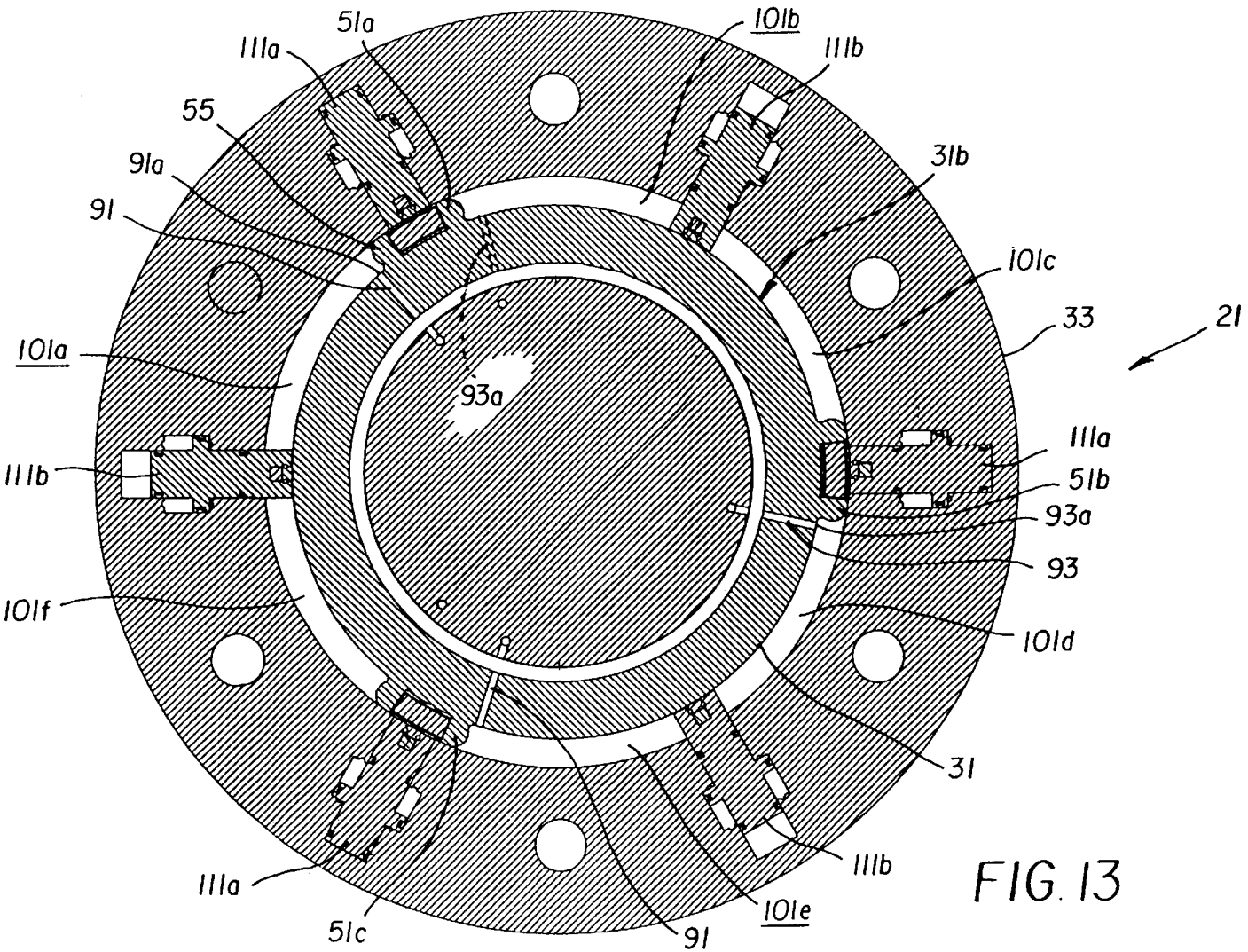
FIG. 13 is a cross-sectional view through line 13—13 in FIG. 4.
Figure 14:
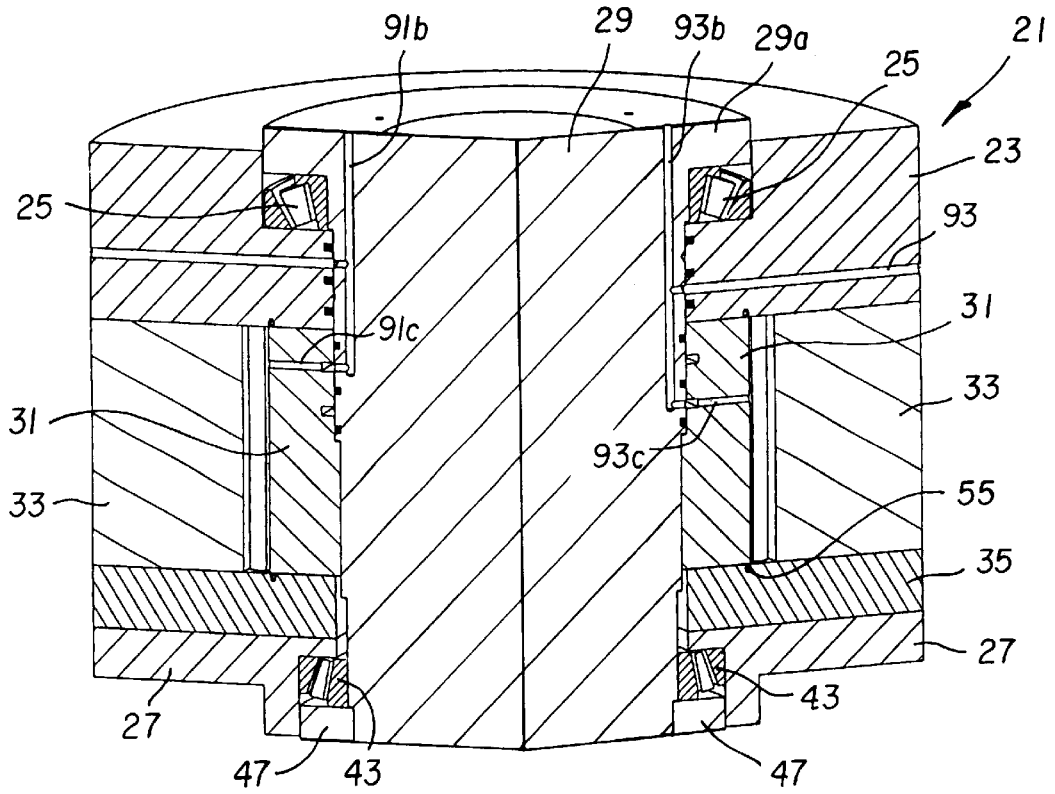
FIG. 14 is a vertical cross-sectional view through line 14—14 in FIG. 12.

FIGS. 12 and 13 provide cross-sectional views of the actuator 21 in FIG.4, and FIG. 14 provides a cross-sectional view of the actuator 21 in FIG. 12. These views illustrates additional aspects of the present actuator 21. Firstly, a first fluid pressure passage 91 is provided having an outlet pressure port 91*a* on the outer radial surface 31*b*. The pressure port 91*a* is positioned adjacent the rear flange 55 of rotor vane 51 and, thus, openly communicates with the pressure cavity 101*a* immediately upstream of the rear flange 55 during operation of the actuator 21. Further, a second fluid pressure passage 93 is provided having an outlet pressure port 93*a* on the outer radial surface 31*b* adjacent the front flange 51*a* of a second rotor vane 51. As shown in the drawings, the second rotor vane 51 is located across a common arc segment 71 from the first rotor vane 51. During operation of the actuator 21, the pressure port 93*a* openly communicates with the pressure cavity 101*b* located immediately adjacent (clockwise from) the flange 51*a*. As described previously, the pressure passages 91, 93 are in direct fluid communication with (and thus controlled by) the servo-hydraulic control system 171.

Accordingly, the pressure or fluid passages 91, 93 and pressure ports 91*a*, 93*a* fluidly communicate with pressure cavities, such as pressure cavities 101*a* and 101*b* in FIG. 13, so as to pressurize the cavities 101, thereby applying a differential pressure across any structure situated therebetween. In this respect, each of the pressure ports 91*a*, 93*a* provides a critical element of the actuator fluid pressure drive system that is operable to drive rotation of the rotor 31 relative to the stator assembly 33. A more detailed description of the structure and operation of the fluid pressure system or circuit is discussed in detail below.

In yet another aspect of the invention, a first balance groove 95 is located on the outer radial surface 31*b* at a position immediately counter-clockwise of each rear flange 55 (see e.g., FIG. 9). The first balance groove 95 is an elongated indentation etched on or otherwise provided on the outside radial surface 31*b*. In the embodiment depicted in the Figures, the balance groove 95 is preferably spaced such that, prior to a stator vane 111 being retracted, a leak path is provided across the stator vane's sealing element 125

(at the interface of the stator vane sealing element 125 and the radial surface 31*b*). This ensures establishment of sealing forces between the rotor surface 31 and the stator vane seals 125, which are not to be retracted. The balance grooves 95 also act to relieve side loads on the vanes which are to be retracted (prior to these vanes 111 being retracted). The length of the first balance groove 95 is determined relative to the length of a sealing face of the stator assembly 33 which sealingly engages the outside radial surface 31*b* of the rotor 31. The balance grooves 97 are sized to provide minimum leakage and shaped so as not to damage a passing stator vane seal. Similarly, a second balance groove 95 is located adjacent but clockwise of each front flange 53.

It is noted that, in this particular embodiment of the invention, each arc segment 71 of the outside radial surface 31*b* is equipped with both a pair of outlet ports 91*a*, 93*a* and a pair of balance grooves 95, 97. In alternative embodiments, the arc segment 71 may be provided with a fewer or larger number of outlet ports and/or balance grooves.

Figure 15A:
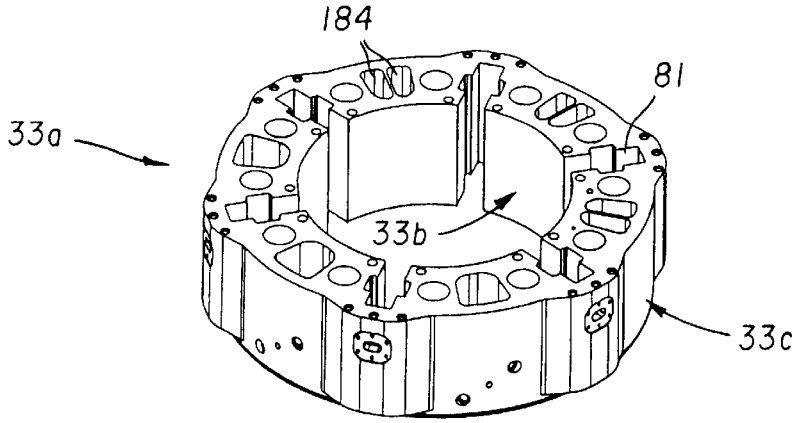
FIGS. 15A–15C are detail views of a stator body according to the invention.
Figure 15B:
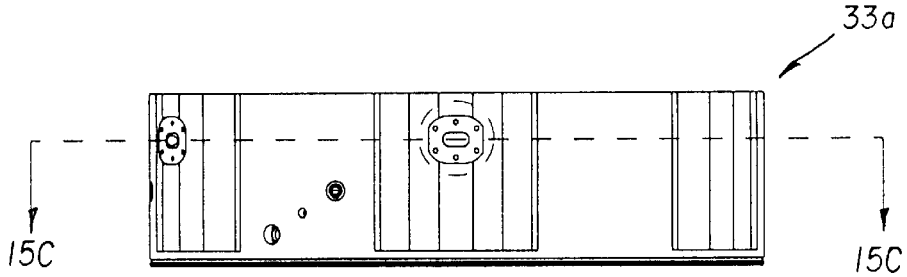
Figure 15C:
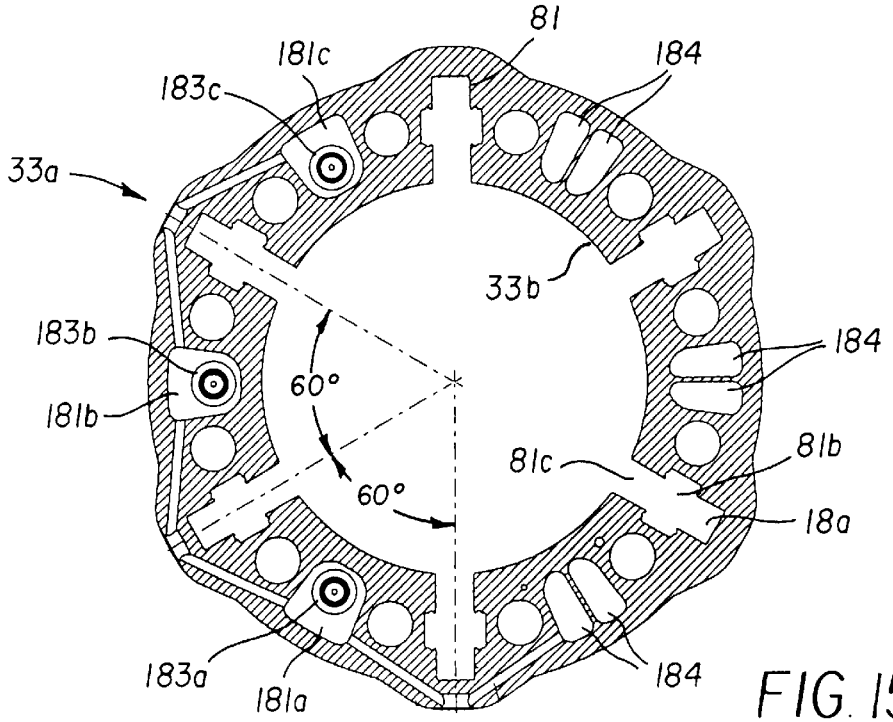

The stator assembly 33 comprises a substantially cylindrical body 33*a* that is disposed concentrically about the rotor 31. The cylindrical body 33*a* is bounded by the inner radial surface 33*b* and an outer radial surface 33*c*. As shown in FIG. 14, for example, the stator assembly 33 is secured between the upper end cap assembly 23 and the valve body 35 via the multiple dowels 61. FIGS. 15A–15C depict the cylindrical stator body 33*a* of the stator assembly 33 independently of the rest of the actuator 21. The cylindrical body 33*a* is equipped with six equally-spaced cavities cut vertically through the stator body 33*a* and horizontally spaced at 60 degree intervals. These cavities form stator vane pockets 81 for housing the radially movable stator vane assemblies 111 and are fluidly interconnected via a plurality of fluid passages and ports with the stator vane control circuit (and a stator vane balance circuit), as will be further described below.

The stator vane pockets 81 have a general "cross"-shape as viewed from a top view (see e.g., the horizontal cross-section of FIG. 15C). More particularly, the stator vane pocket 81 may be referred to as having a narrow section or back section or compartment 81*a*, an intermediate flange section 81*b*, and a front portion 81*c* that opens through the inside radial surface 33*b* of the stator body 33*a*. The stator vane pockets 81 extend vertically through the stator assembly 33 and is sealed above the stator assembly 33 by the bottom surface of the upper end cap assembly 23 and below by the valve body 35. The stator vane pocket 81 is shaped and configured so as to accommodate the shape of the stator vane assembly 111. Moreover, the stator pockets are configured to form fluid-receiving cavities between the stator vanes assembly 111 and the stator pocket walls and to accommodate the reciprocal radial movement of the stator vane assembly 111 therein.

In addition to dowel holes, the stator body 33*a* is also equipped with three vertically disposed valve cavities 181*a*, 181*b*, 181*c* for retaining three cartridge valves 183*a*, 183*b*, 183*c* (see also FIGS. 3 and 6) Two of the cartridge valves 183*a*, 183*b* are preferably four-way, two-position solenoid-operated cartridge valves such as a type commercially available from Deltrol Company. Referring to the cross section of FIG. 6, the bottom stem portion of the valve 183*a* is secured to the stator body 33*a* where its parts fluidly communicate with fluid passages 185 provided in the body 33*a* and with fluid passages 55 in the valve body 35. The third valve 183*c* is preferably a three-way, two-position solenoid operated cartridge valve that is disposed in fluid communication with the brake piston assembly 37*g* and operable therewith. The remaining cavities 184 are provided for balancing purposes and as reserve.

Figure 16:
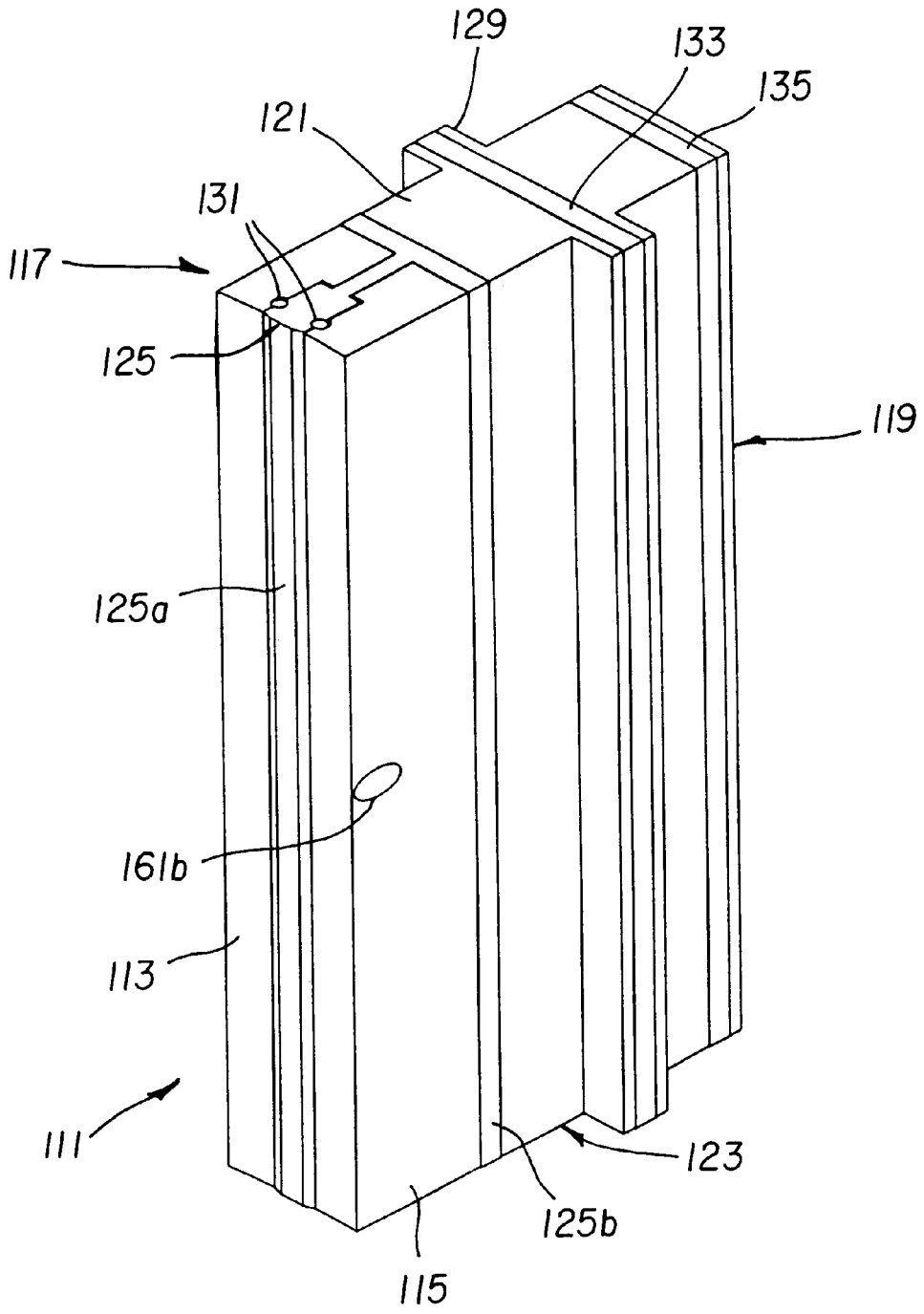
FIG. 16 is a detail view of a stator vane assembly for the elbow actuator in FIG. 1.
Figure 17:
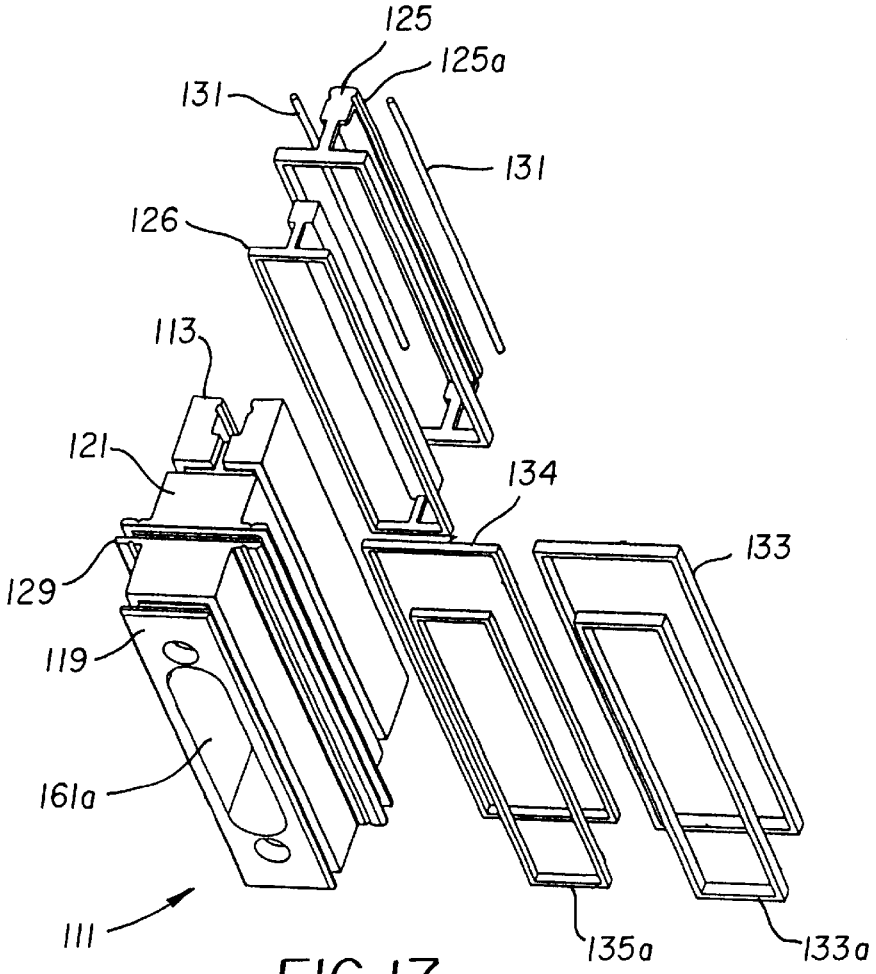
FIG. 17 is an exploded view of the stator vane assembly in FIG. 16.
Figure 18:
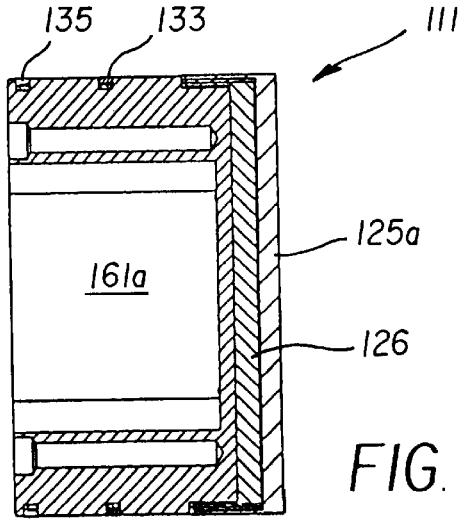
FIG. 18 is a vertical cross-sectional of the stator vane assembly in FIG. 16.

FIG. 16 depicts a typical stator vane assembly 111 of the present invention that is positionable within one of the stator vane pockets 81 of the stator assembly 33, and radially movable therein in reciprocal fashion. The detailed views of FIGS. 17 and 18 provide further details of the construction of the stator vane assembly 111. The stator vane assembly 111 has a front sealing face 113 that is sealingly engageable with the outside radial surface 31*b* of the rotor 31, a first side face 115, a second side face 117, a back face 119, a top face 121 and a bottom face 123. A multi-section front stator seal 125 extends vertically along the center of the front sealing face 113, along the top and bottom faces 121, 123, and vertically along the side faces 115, 117. Grooves are provided in the stator vane faces 115, 117, 121, and 123 so as to accommodate and secure the front stator seal 125. The stator seal 25 works in conjunction with a preferably viton seal energizer 126 secured in the grooves behind the front stator seal 125.

During operation of the stator vane 111, the front stator seal 125 sealingly engages the inside walls of the stator vane pocket 81, the bottom surface of the upper end cap assembly 23, and the valve body 35, as well as the rotor 31. As shown in FIG. 16, the front sealing face 113 is angled slightly inwardly to produce a slightly concave shape and such that the front portion 125*a* (on the front sealing face 113) of the front seal 125 clearly protrudes radially therefrom. Accordingly, the contour of the front sealing face 113 approximates the curvature of the outside radial surface 31*b* of the rotor 31 and the front portion 125*a* of the seal 125 is particularly adapted to sealingly engage the outside radial surface 31*b*. Further, a pair of vertical grooves are drilled through the front portion of the stator vane 111 so as to house a pair of longitudinally extending rod elements 131. The rod elements 131 are positioned adjacent each side of the portion 125*a* extending the length of the stator vane 111. The positioning of the rod elements 131 in the grooves functions to bias and/or lock the front portion 125*a* of the front seal 125 in the radially protruding disposition described above. In the embodiment of FIGS. 1–20, the rod elements 131 are preferably constructed from an oilite bronze material.

The stator vane 111 also has a peripheral flange portion 129 between the front sealing face 113 and the back face 119. A peripheral groove is provided on the flange portion 129 to house a second seal assembly 133 including a seal energizer 133*a* and a continuous peripheral seal 133 over the seal energizer. During operation of the stator vane 111, the flange portion 129 moves radially in the wider flange section 81*b* of the stator vane pocket 81*b* and with the peripheral seal 133 sealingly engaging the walls of the stator pockets 111, the bottom of the upper end cap assembly 23 and the valve body 35. The flange portion 129 also functions to limit the radial movement of the stator vane 111 and to provide adequate surface area for applied pressure to move the vane in a radially reciprocating manner.

The stator vane 111 is further equipped with a third seal assembly 135 including a seal energizer 135*a* and a second continuous peripheral seal 135 both secured in a groove near the back face 119. The second peripheral seal 135 functions to sealingly engage the wall of the stator pocket 81 so as to isolate the back compartment 81*a* from the front compartment 81*c*. Accordingly, pressure cavities 151 are created in the flange portion of the stator pocket 81 (see FIG. 12). This pressure cavity 151 is divided by the peripheral seal 135, but is disposed in fluid communication with the valve body 35 through first fluid passages 187 (in front of the peripheral flange portion 129) and second fluid passages 199 (behind the peripheral flange portion 129), and, thus, may be pressurized and depressurized by the stator vane control system (described previously). The stator vane 111 may, therefore, be moved radially inward toward the rotor 31 and retracted radially outward with respect to the rotor 31, both in response to fluid directed onto or relieved from the pressure cavities 151. In this manner, the stator vane 111 may be caused to radially move in a reciprocating manner in the stator vane pocket 81 by the control system. Moreover, by achieving positional control of the stator vane 111, the control system is used to synchronize the movement of the stator vane 111 relative to the rotor 31, with rotation of the rotor 31 as operated by the actuator fluid pressure system.

In another aspect of the inventive actuator 21, a laterally extending fluid passage or transfer passage l61 is provided through the stator vane 111, from the back face 119 to near the front edge of the upstream or first side face 117 (see FIGS. 12 and 16). The fluid transfer passage 161 includes a hollowed compartment 161*a* provided in the stator vane 111 and a port 161*b* located on the first side face 117. Therefore, the fluid transfer passage 161 provides open fluid communication between the narrow back compartment 81*c* of the stator vane pocket 81 and the pressure cavity 101 formed immediately clockwise from the stator vane 111.

FIG. 13 illustrates one stage in the typical operation of the hydraulic rotary actuator 21 and engagement of the stator assembly 33 with the rotor 31. In this Figure, three of the stator vanes 111*a* are shown open or sealingly engaging the three rotor vanes 51, while the other three stator vanes 111*b* are closed or sealingly engaging a portion of the outer radial surface 31*b* between the rotor vanes 51. As a result of engagement between the rotor 31 and the stator assembly 33, six discreet pressure cavities 101*a*–101*f* are created. FIG. 13 also shows fluid passage 91 fluidly communicating with pressure cavity 101*e* and fluid passage 93 fluidly communicating with pressure cavity 101*d*. Each pressure cavity is bounded by at least the outside radial surface 31*b* of the rotor 31, the inner radial surface 33*b* of the stator assembly 33, one stator vane 111*a* or 111*b*, and one rotor vane 51. On the top and bottom, the pressure cavity 101 is sealingly bounded by the bottom surface of the upper end cap assembly 23 and the upper surface of the valve body 35, respectively (i.e., metal-to-metal contact). A pair of rotor end seals 179 also provides a seal between the rotor 31 and upper end cap assembly 23 and valve body 35 as previously described (see FIG. 4). In one aspect of the invention, the rotor end seals 179 provides not only a seal to a dynamic interface but permits a clearance provided therein to allow for relative motion between the rotor 31 and the bounding structure.

FIGS. 19 depicts different stages in the operation of the hydraulic rotary actuator 21, wherein the engagement between the stator vane assemblies 111 and the rotor 31 vary. As shown therein, when the stator vane assembly 111 disengages from the rotor vanes 51 and engages a portion elsewhere on the outside radial surface 31*b* of the rotor 31, the number of pressure cavities 101 increases from six to nine (to include pressure cavities 101*g*–101*i*). Therefore, the volume of pressure cavities 101*a* through 101*f* have each been reduced to accommodate the additional pressure cavities 101*g*–101*i*. It is important to note, however, that new pressure cavities 101*g*–101*i* are not in fluid communication with either fluid passage 91 or fluid passage 93. This results because the pressure cavities (101*g*–101*i*) are boarded by adjacent stator vanes 111 in the closed position, and not by a rotor vane 51. Accordingly, these pressure cavities 101*g*–101*i* remain static (e.g., do not vary in volume) until one of the bounding stator vanes 111 opens. However, the volume of the pressure cavities 101*a*–101*f* continue to vary as the rotor 31 rotates relative to the stator assembly 33. In this respect, the stator assembly 33 and the rotor 31 may be referred to as being engageably rotatable relative one another so as to form a number of continuously variable volume pressure cavities 101 therebetween.

In the embodiment depicted of FIGS. 1–20, rotation of the rotor 31 relative to the stator assembly 33 is primarily governed (i.e., driven) by operation of a fluid pressure system (or fluid pressure drive system or circuit). The fluid pressure system includes servo-hydraulic control valve 161, the fluid passages 91, 92 and the pressure cavities 101. The fluid pressure system delivers fluid into a pressure cavity 101 through fluid passage port 91*a* while relieving fluid from an adjacent pressure cavity 101 through fluid passage port 93*a*. Thus, the pressure cavity 101 whereto fluid passage 91 delivers fluid increases in volume and in pressure to provide a differential pressure which acts on the rotor vane 51. As a result, the rotor 31 moves in the angular direction and the adjacent clockwise cavity 101 (bounded by the rotor vane 51 and the adjacent clockwise stator vane 111) reduces in volume.

Referring to FIG. 14, the first fluid passage 91 extends from a pressure source (and from the servo-hydraulic control system 171) laterally through the upper end cap assembly 23. Then, that portion of the fluid passage 91 engages a corresponding passageway 91*b* in the output shaft 29. The output shaft passageway 91*b* extends vertically in the output shaft 29. In the area of the rotor 31, a second lateral portion 91*c* of the fluid passage 91 extends through the rotor 31 out through one of the arc segments 71 of the outside radial surface 31*b*. By way of fluid passage 91, fluid pressure may be communicated through the end cap assembly 23, through the output shaft 29, through the rotor 31 and into one of the variable volume pressure cavities 101. A second fluid port 93 extends in a similar manner from the upper end cap assembly 23 to the output shaft 29, through the rotor 31 and into one of the pressure cavities 101. Referring to FIG. 10, both the pressure ports 91*a*, 93*a* are located on each arc segment 71 of the outside radial surface 31*b* but positioned adjacent to different rotor vanes 51. In the following description of the operation of the actuator 21 (wherein the rotor 31 rotates in the clockwise direction as viewed from the top end), the pressure port 91*a* acts as a pressure supply or fluid supply port, whereas the pressure port 93*a* acts as a fluid return or pressure relief ports.

Figure 19A:
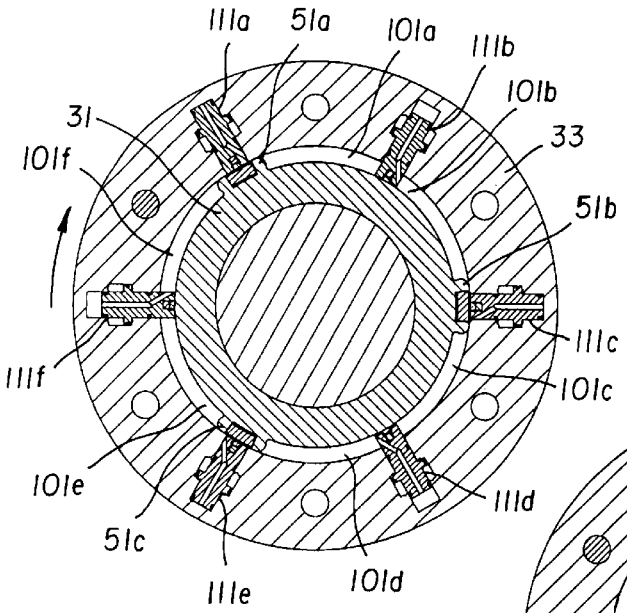
FIGS. 19A–19K are cross-sectional views of the elbow actuator in FIG. 1 at sequential phases of rotor rotation.
Figure 19B:
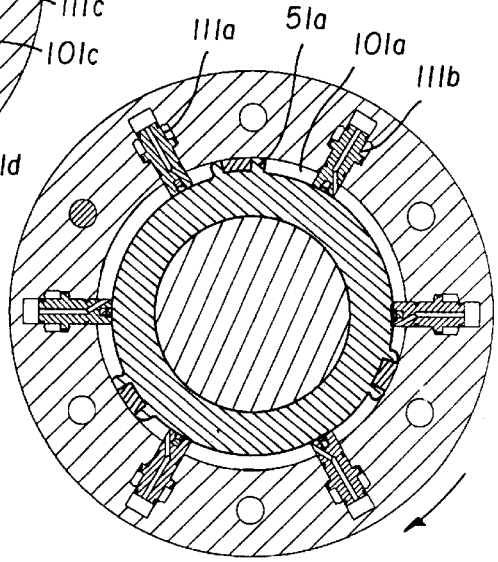
Figure 19C:
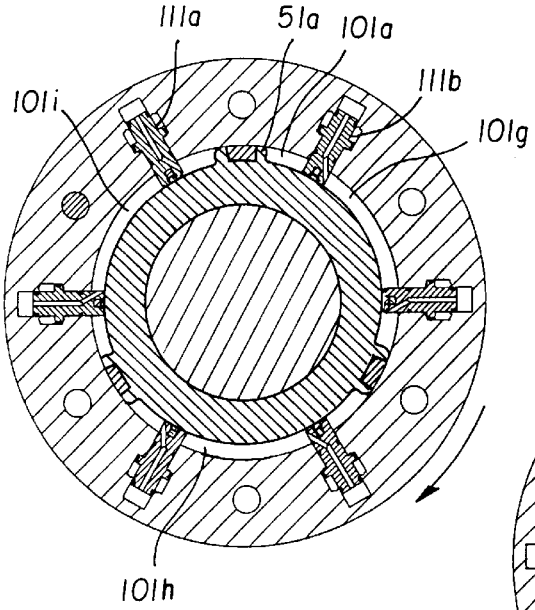
Figure 19D:
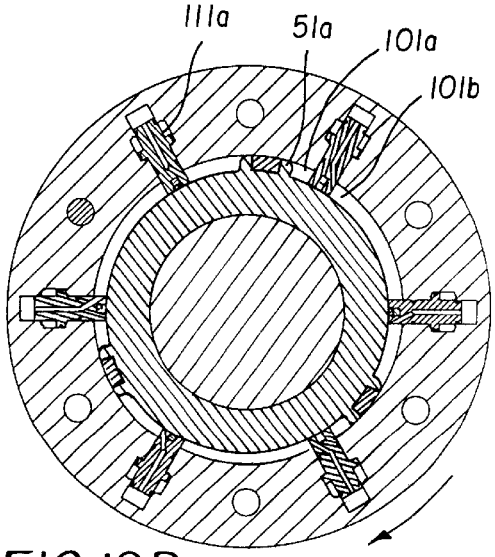
Figure 19E:
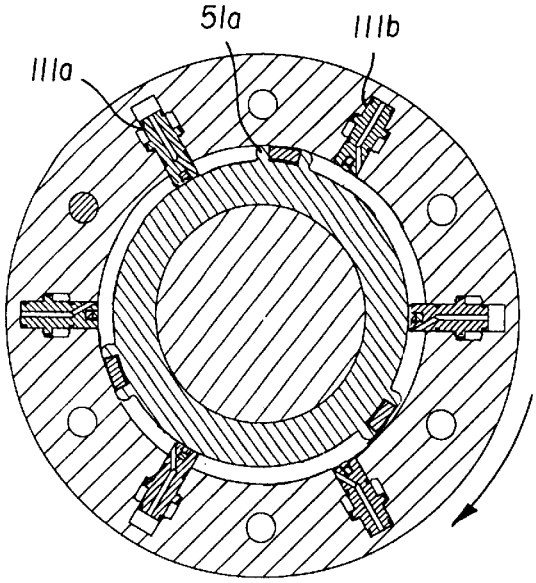
Figure 19F:
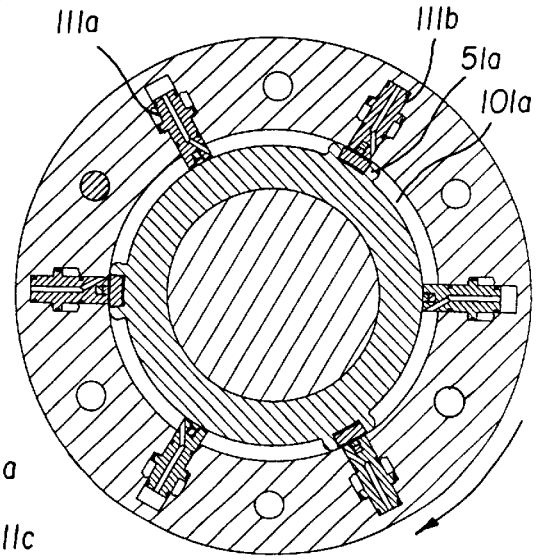
Figure 19G:
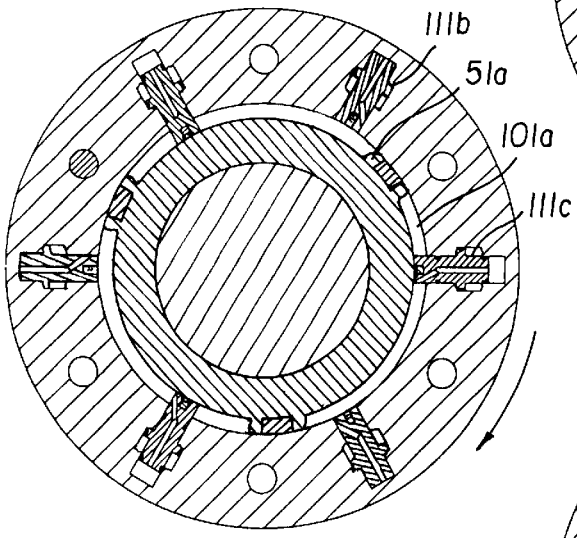
Figure 19H:
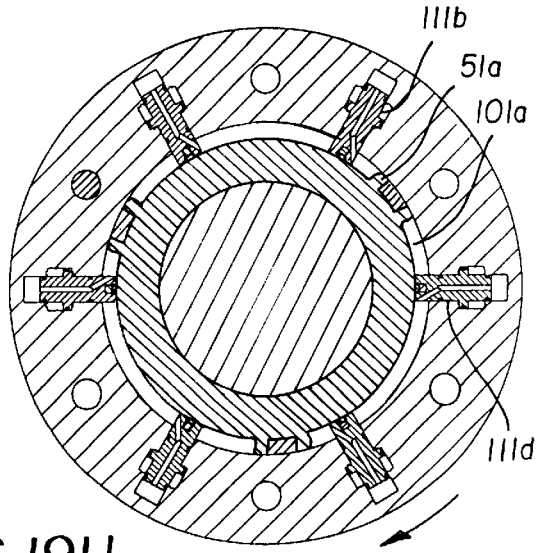
Figure 19I:
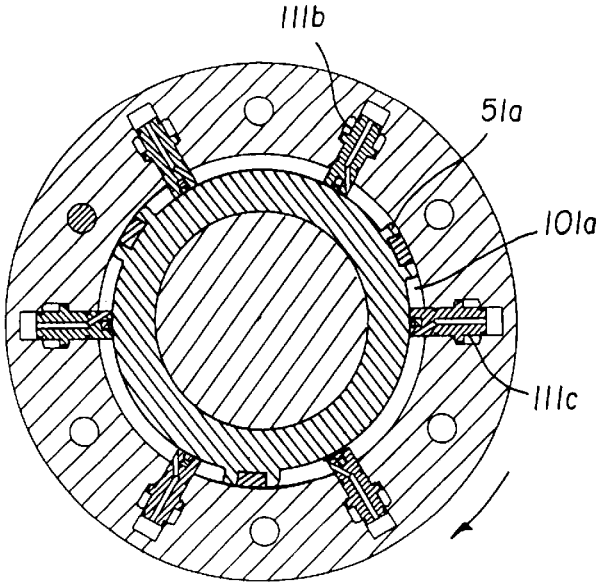
Figure 19J:
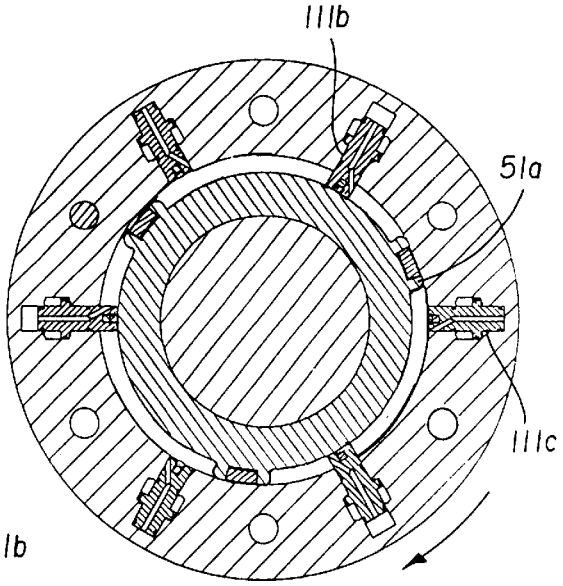
Figure 19K:
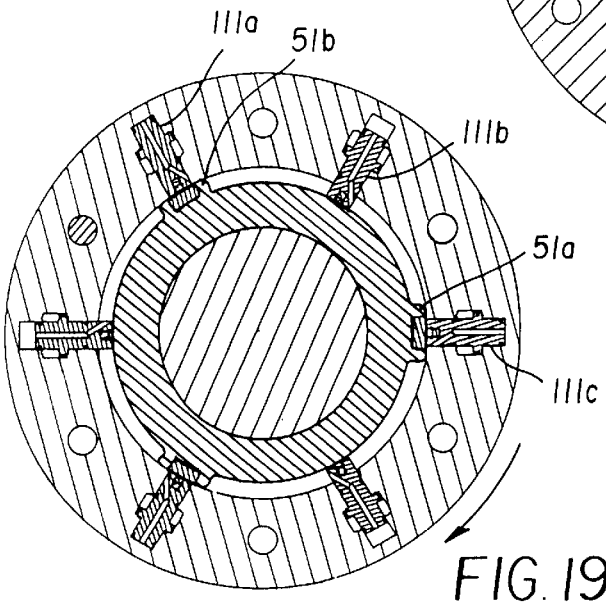
Figure 21:
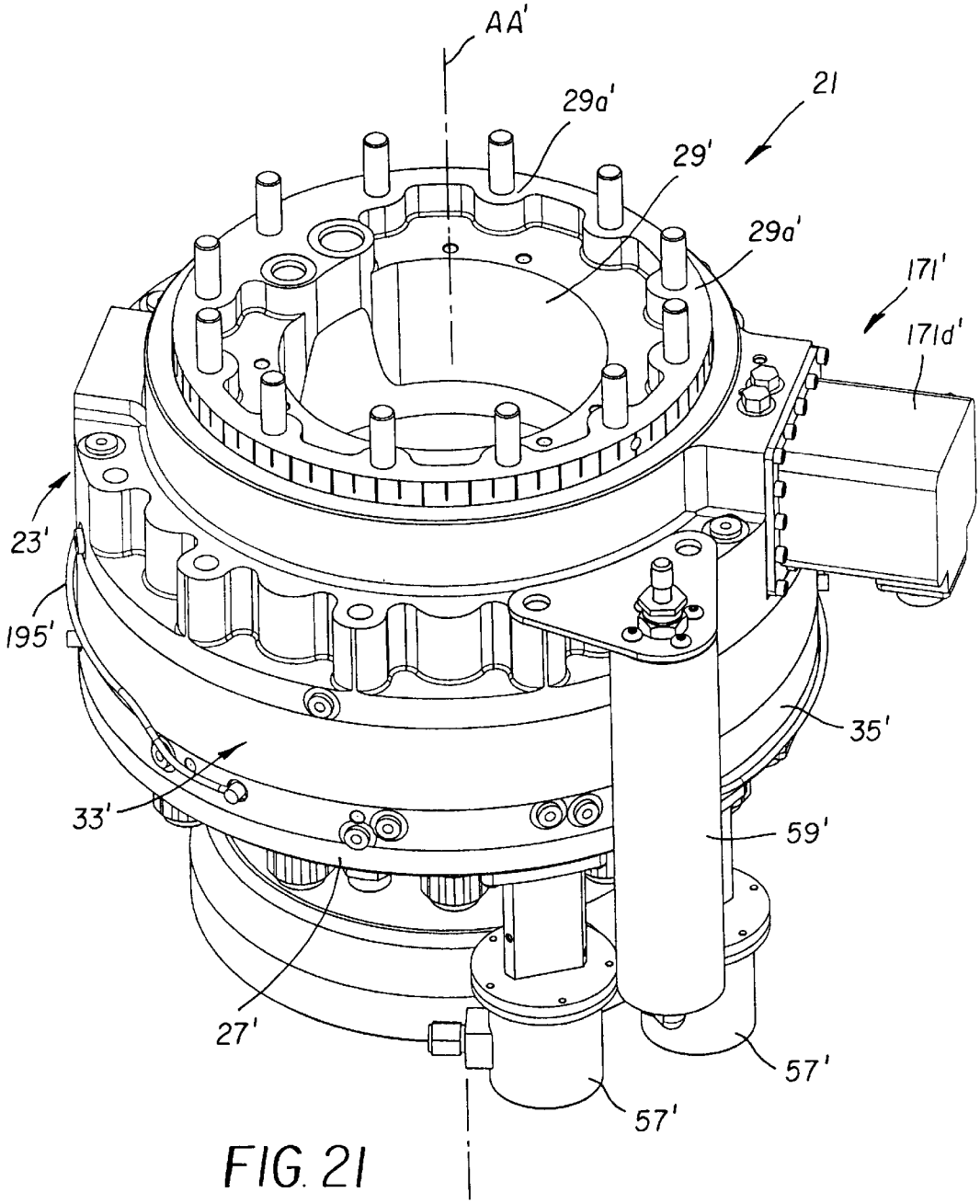
FIG. 21 is a top perspective view of a wrist actuator according to the invention.
Figure 22:
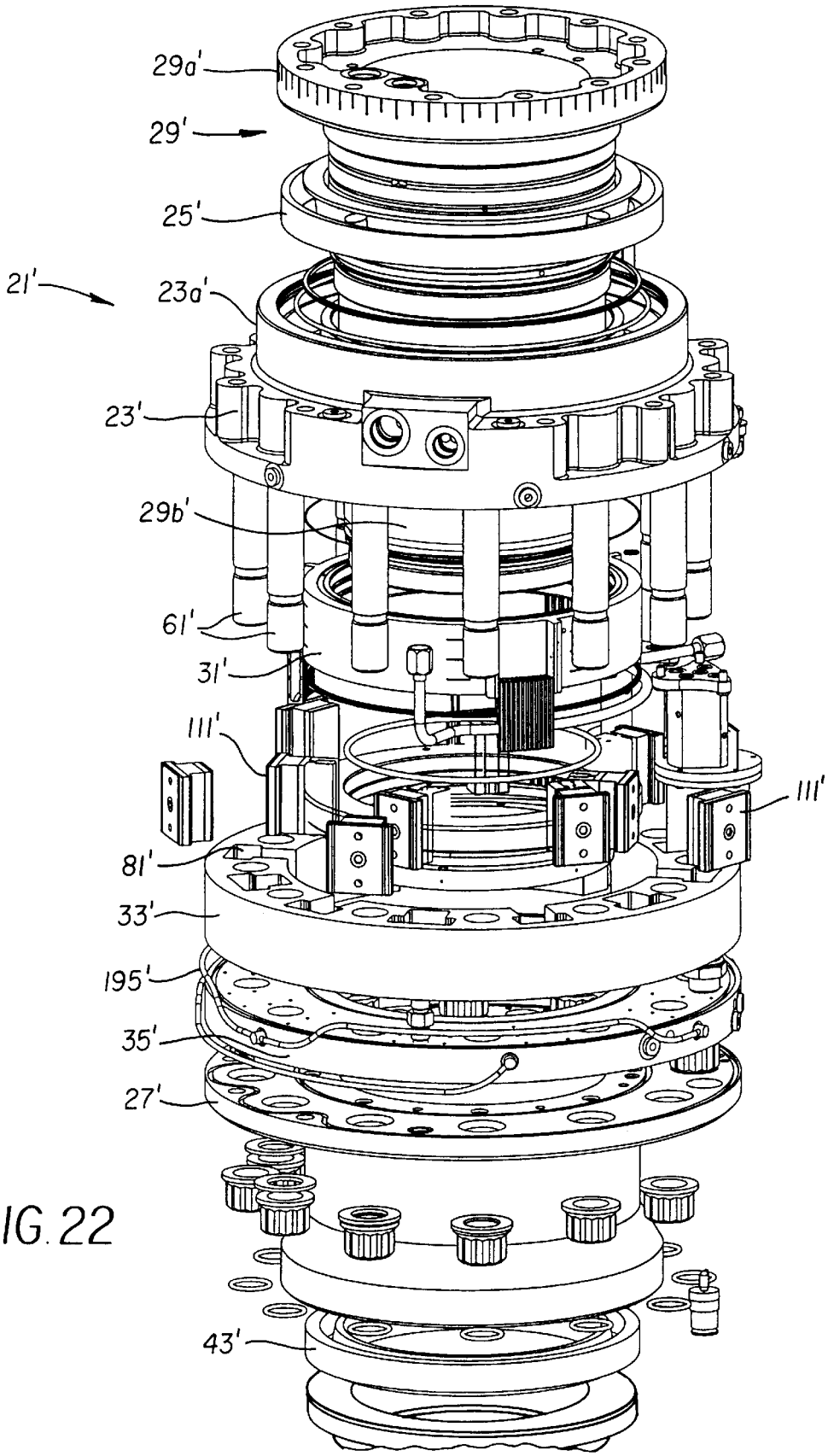
FIG. 22 is an exploded view of the wrist actuator of FIG. 21.
Figure 23:
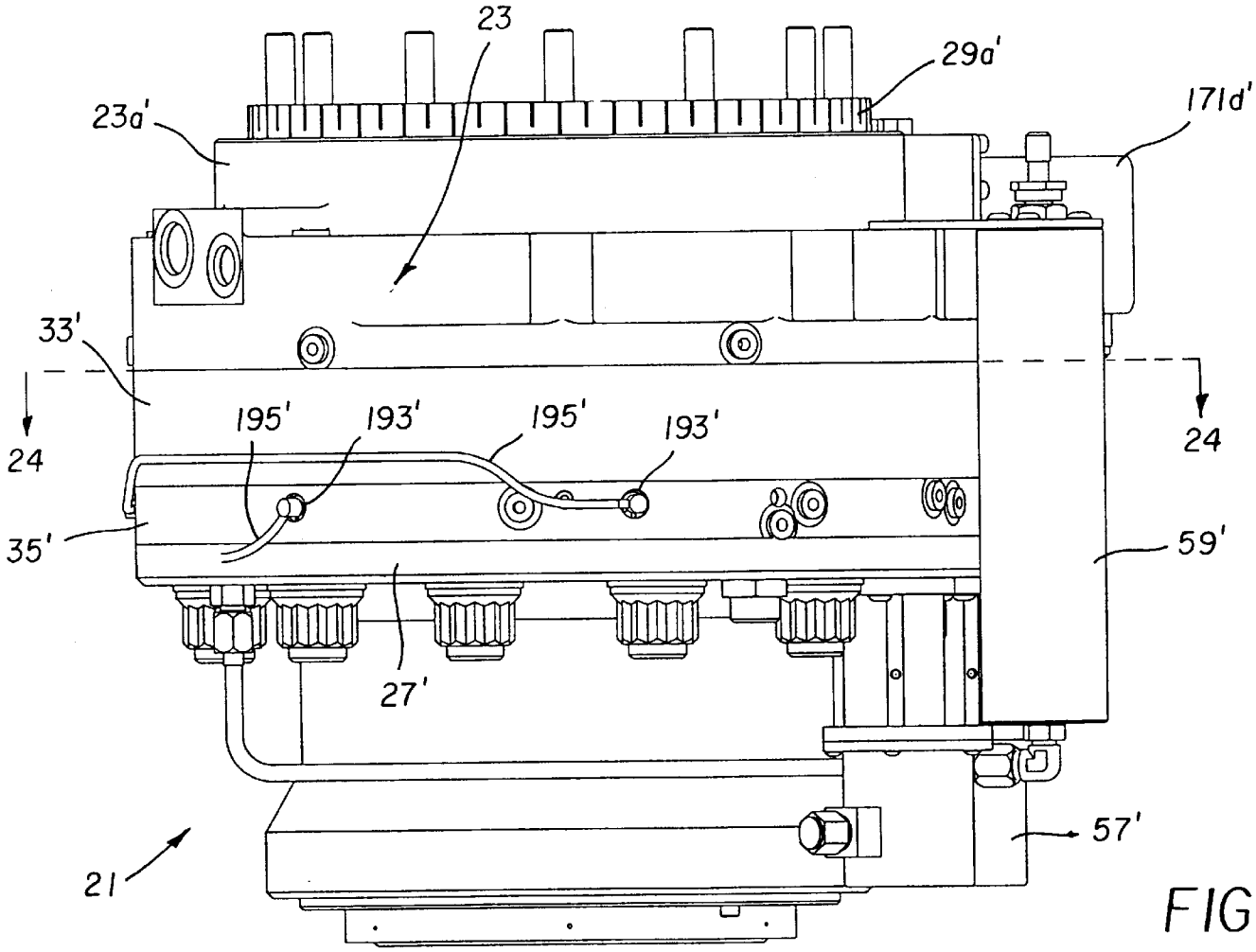
FIG. 23 is a side elevation view of the wrist actuator of FIG. 21.
Figure 24:
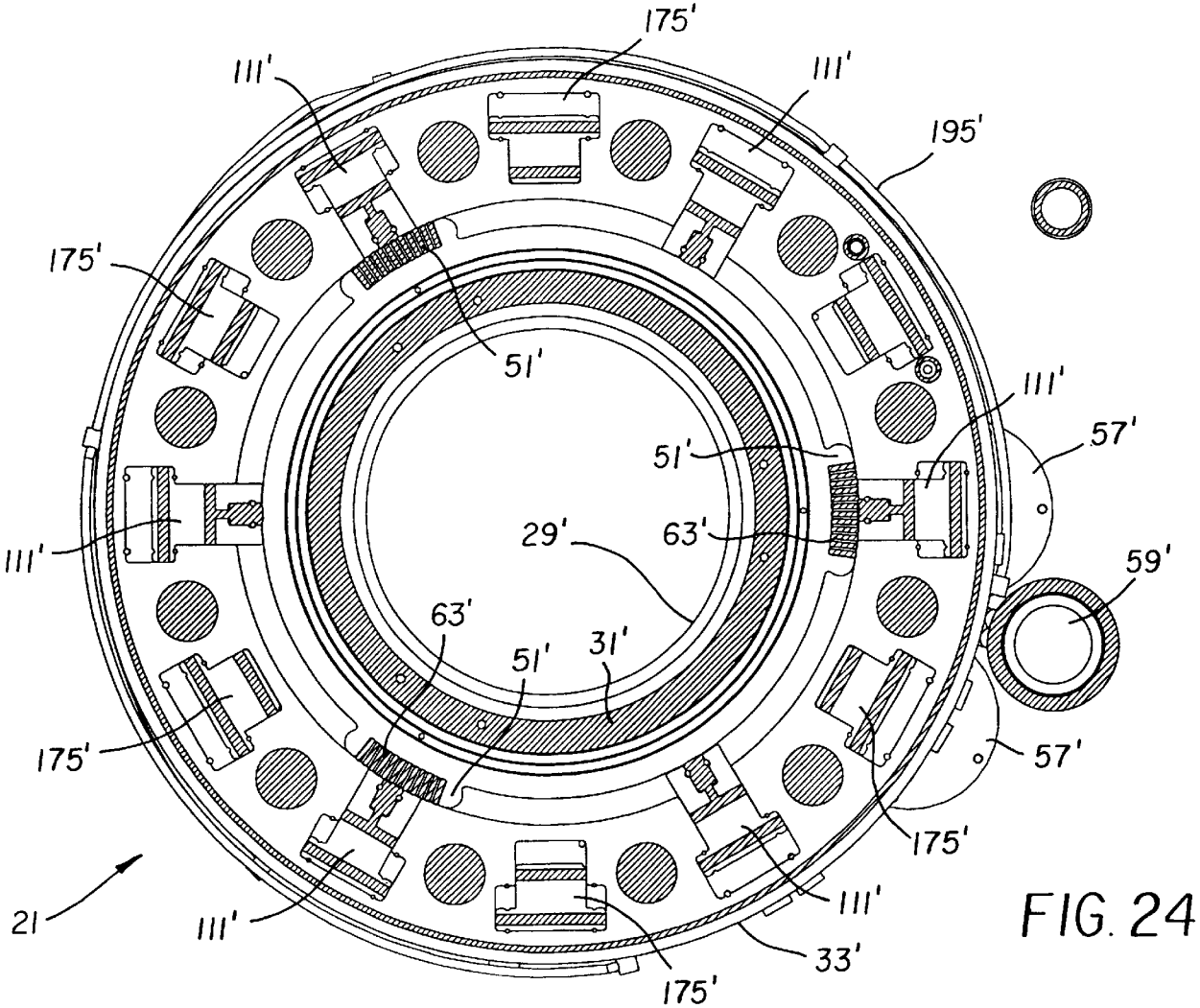
FIG. 24 is a horizontal cross-sectional view through line 24—24 in FIG. 23.

Operation of the hydraulic rotary actuator 21 according to the invention will now be described. FIG. 13 and FIG. 19A depict a stage in the rotor rotation wherein the three rotor vanes 51 are engaging three open or retracted stator vanes 111*a*, 111*c* and 111*e*. In operation, these three stator vanes 111*a*, 111*b*, 111*c* are referred to as "phase A" stator vanes and operate in conjunction with a common cartridge valve 183*a*. The other three stator vanes 111*b*, 111*d* and 111*f*, which are in the closed positions, are referred to as "phase B" stator vanes and operate in conjunction with the cartridge valve 183*b*. The actuator 21 produces torque at the output shaft 29 by operating the fluid pressure system (i.e., including the servo-hydraulic control system 171) to direct fluid flow through corresponding fluid passages 91 and 93 and into pressure cavities 101 (e.g, 101*a* and 101*b*) defined on opposite sides (clockwise or counter-clockwise) of each the rotor vane 51 (e.g., 51*a*). As described previously, a first fluid passage port 91*a* is located on the counter-clockwise side of each rotor vane 51 while a second fluid passage port 93*a* is located on the other or clockwise side of the same rotor vane 51. For example, pressurized fluid directed through the fluid passage port 91*a* and into pressure cavity 101*a,* defined by rotor vane 51*a* and phase B stator vane 111*f,* induces a separating force that acts between the rotor vane 51*a* and the stator vane 111*f.* A differential pressure is applied to the rotor vane 51*a* because the next adjacent pressure cavity 101*b* (clockwise of the rotor vane 51*a*) (not shown in FIG. 6) is at a pressure that is less than that of pressure cavity 101*a.* Moreover, fluid pressure port 93*a* relieves fluid from this pressure cavity 61*b.* Since the stator vane 111 is secured to the fixed housing assembly, the rotor 31 moves in the clockwise direction to expand pressure cavity 101*a* and reduce volume pressure cavity 101*b,* thereby producing torque at the coupling end 29*a* of the output shaft 29.

A set of synchronized events takes place with respect to the stator vanes 111 as the rotor 31 proceeds through rotation (see the hydraulic schematic of FIG. 20.) As described previously, the stator vanes 51 reciprocate radially within the stator vane pocket 81 to closed and open positions by utilizing the stator vane control system (e.g., cartridge valve, 183*a* and 183*b*) to direct pressure into and out of the pressure cavity 151 of the stator pocket 81 through fluid passage 187, 189 (see e.g., FIG. 3 for fluid passages 187, 189). Operation of four-way cartridge valve A (183*a*) directly controls the positioning of phase A stator vanes 111*a,* 111*c,* 111*e,* while operation of four way cartridge valve B (183*b*) directly controls positioning of phase B stator vanes 111,*b,* 111*d,* 111*f.*

Synchronization is accomplished by means of rotor position feedback to the control system which then energizes and de-energizes the 4-way solenoid valves 183*a* (see FIG. 20A). Accordingly, in a method of operating a rotary actuator according to the present invention, operation of the stator vane control circuit may be synchronized with operation of the fluid pressure control circuit and, as such, reciprocal radial movement of the stator vanes 111 is synchronized with angular movement of rotor 31. As a result, rotor 31 may be rotated smoothly and continuously through a plurality of cycles. As discussed briefly above, the principal fluid control components utilized in this operation are preferably the 4-way, 2-position solenoid-operated cartridge valves A and B (183*a,* 183*b*), and the 3-way, 2-position solenoid operated cartridge valve 171*a.*

In the graphical illustration of FIG. 20B, the operating conditions of valves A and B (183*a,* 183*b*) are indicated with respect to the angular position of rotor vane 51*a,* through and beyond 360 degrees of rotation. Further, FIG. 19 illustrates the positioning of all the stator vanes 111 and all of the rotor vanes 51 through clockwise angular movement of the rotor 31 from 0 to 120 degrees. Thus, FIG. 19 may be examined in conjunction with the graphical illustration of FIG. 20B to determine the "respective" positions of valves A and B, the stator vanes 111, and the rotor vanes 51. For example, at 0 degrees, FIGS. 19A and 20B indicate that valve B (183*b*) is energized but valve A (183*a*) is de-energized. Thus, the phase B stator vanes 111*b,* 111*d,* and 111*f* are closed by directing pressure to compartment 151*a* of the appropriate stator pockets 81*b,* 81*d,* 81*f.* Conversely, the phase A stator vanes 111*a,* 111*c,* 111*e* are in the retracted position, with the pressure cavities 152 (see FIG. 12) being fluidly pressurized by operation of valve A (183*a*).

It should be noted that synchronized actuation of the stator vanes 111 with rotation of the rotor 51 may be accomplished through a variety of alternative techniques. These techniques are not covered here in detail but would be apparent to one skilled in the act upon reading the description and viewing the drawings, both of which are provided herein.

It should be noted that, in yet another aspect of the invention, a seal is maintained between the rotor 31 and the appropriate stator vanes 51 at all times. This is achieved through novel design of the stator vane 111 and the rotor vane 51, and the combined operations of the fluid pressure system of the actuator 21 and the stator vane control system. In the closed position of the stator vane 111, a bounding seal is performed between the stator vane front seal 125 and the valve body 35, the upper end cap assembly 23, and the walls of stator vane pocket 81 and the outside radial surface 31*b* of the rotor 31. In the open position of the stator vane 111, the rotor vane 51 is able to rotate past the retracted stator vane 111 while maintaining the same bounding seal that is formed at all other angles of the rotor 31.

In FIG. 19A, all three rotor vanes 51 are engaging (but are about to pass) the three Phase A stator vanes which are in the open positions. In this stage of operation, pressure cavities 101*a*–101*f* are at full volume. In FIG. 7C, the Phase A stator vanes have been moved to the closed position thereby creating three additional reduced volume pressure cavities 101*g,* 101*h,* 101*i.* Since these cavities (101*g,* 101*h,* 101*i*) are located between and bounded by stator vanes 111, these cavities (101*g,* 101*h,* 101*i*) do not fluidly communicate with a fluid passage port 91*a* or a fluid passage port 93*a* and, thus, do not vary in volume until one of the adjacent stator vanes 111 once again opens. In FIG. 7D, the rotor 31 continues rotation through a precise dwell angle during which all stator vanes 111 (Phase A and Phase B) are in the closed positions. In FIG. 7F, the phase B stator vanes have been retracted to the open positions just before the rotor vanes 51 sealingly engages these Phase B stator vanes. Clockwise rotation continues thereafter, with the Phase B stator vanes immediately returning to the closed position to define, in part, three reduced (but expanding) volume pressure cavities 101 immediately counter-clockwise of the rotor vanes 51. Further rotation of the rotor 31 is synchronized with the Phase A vanes retracting to open and then closed positions until the rotor has traveled 360 degrees. Thereafter, the rotor cycle repeats with further continuous clockwise rotation and without a pause or change of direction in the rotation of the rotor 31 relative to the stator assembly 33.

As described previously, the stator vanes are equipped with internal fluid passages or transfer passage 161. When a stator vane 111 moves from an open position (sealingly engaging a rotor vane 51) to a closed position (sealing engaging a portion of the arc segment 71 of the outside radial surface 31*b*), fluid displaced by the advancement of the stator vane 11 into the adjacent pressure cavities 101 (to engage the outer radial surface 31*b* of the rotor) flows through the transfer passages 161 and to the back compartment 83 of the stator vane pocket 81. The fluid volume provided by the back compartment 83 is determined to approximate the volume of the portion of stator vane 111 thrust into the pressure cavities 101 (and thus the volume of the displaced fluid formerly therein). When the stator vane 111 is subsequently retracted to an open position, the space or volume in the pressure cavities 101 formerly occupied by the portion of the stator vane 111 is compensated by an equal volume of fluid displaced from the back compartment 83, which is transferred through the transfer passage 161. Accordingly, a disruption in the gradual pressurization or depressurization of the pressure cavities 101 is avoided and a constant pressure cavity volume is maintained during stator vane 111 transitions (i.e., positional changes negating rotational effects). It should be noted that the fluid transfer passages 161 may fluidly communicate with the pressure chamber 191 either on the clockwise or counter-clockwise side of the stator vane.

In another aspect of the invention, a stator balance circuit is provided to prevent or minimize radial loads which may result when all of the phase A and/or phase B stator vanes 111 are extended (open). The stator balance circuit comprises a phase A circuit and a phase B circuit. The phase A circuit fluidly communicates with each of the back compartments 81a of the stator pockets 81 for phase A stator vanes 111, while the phase B circuit fluidly communicates with the back compartments 81*a* of the stator pockets 81 of the phase B stator vanes 111. These circuits are defined, at least, by fluid ports 193 in the back compartment 81*a* of the stator pockets 81 which fluidly communicate with one of the circumferential passages 195 in the valve body (see FIG. 9). Thus, open fluid communication between the appropriate stator pockets 81 allow for even distribution of pressure loads (e.g., radial loads) in the circuit to effect self-balancing.

In the wrist-type actuator embodiment depicted in FIGS. 21–27, the circuits employ fluid tubing lines l95' disposed on the outside of the stator body 33*a*. These tubing lines 195' are fluidly connected to fluid ports 193 in the back compartment 81*a'* of the appropriate stator pockets 81' (see FIG. 23).

In another aspect of the invention, balance grooves 95 are provided along the outside radial surface 31*b* of the rotor 31 adjacent both sides of the rotor vane 51 (see FIG. 10). These balance grooves 95 provide leak paths along the outer radial surface 31*b* such that, as the rotor 31 rotates through the dwell angle when all stator vanes 111 are closed, fluid can leak between the rotor 31 and the stator vane, front seal 125 that is designated to open next. Provision of such controlled leakage accomplishes at least two objectives. First, differential pressure across the stator vane front seal 125 is maintained so as to remain in contact with the rotor 31, and to energize the seal 125. Secondly, the balance grooves 95 allow for hydrostatically balancing the stator vane 111 prior to the stator vane 111 being retracted to open positions, thereby eliminating any side loads effected on the stator vane 111.

By providing multiple rotor vanes 111, multiple pressure cavities 101 are created and thus, the torque output of the actuator is also multiplied. Preferably, the stator vanes 111 and the rotor vanes 51 are symmetrically positioned so as to provide for hydraulic balancing, which results in minimizing the radial loads on the rotor 31 when there are multiple rotor vanes 51. As will become apparent to one skilled in the art, the number of rotor vanes 51 is limited significantly only by structural stresses in the stator vanes 111 and rotor vane flanges 53, 55, and maximum desired rotational velocities.

Although the embodiment depicted and described herein primarily relates to the structure and operation of a wrist type and an elbow type hydraulic rotary actuator 21', 21, the invention is also adapted to other structures and other operations. For example, many of the inventive components described herein (e.g., stator vane assembly, synchronized operation, seal assemblies, etc.) are adapted to other machines and are not limited to fluid-driven rotary actuators or other types of rotary actuators. Such applications in, thus alternative methods of the invention, will be apparent to those skilled in the art, upon viewing the drawings and reading descriptions which are provided herein.

For example, FIGS. 21 through 27 depict a wrist type hydraulic rotary actuator 21', also incorporating the synchronized and continuous rotary motion aspects of the invention described above. Like numerals as employed in FIGS. 1–20 of the elbow-type actuator of the invention are used to indicate like elements in the wrist-type actuator 21' of FIGS. 21 and 27.

Figure 25:
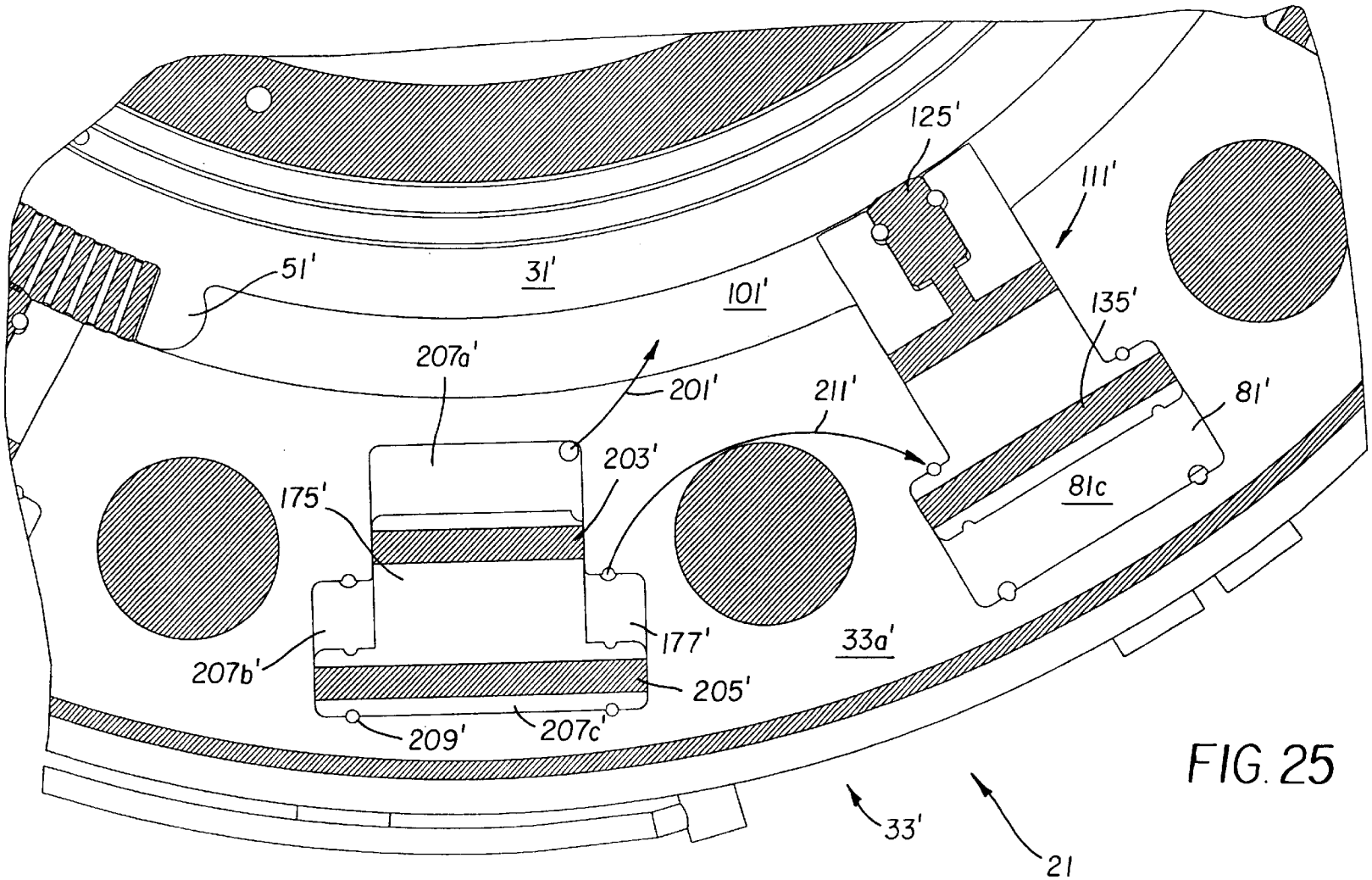
FIG. 25 is a diagrammatical view of a stator vane assembly—slave vane assembly for the elbow actuator of FIG. 21.
Figure 26:
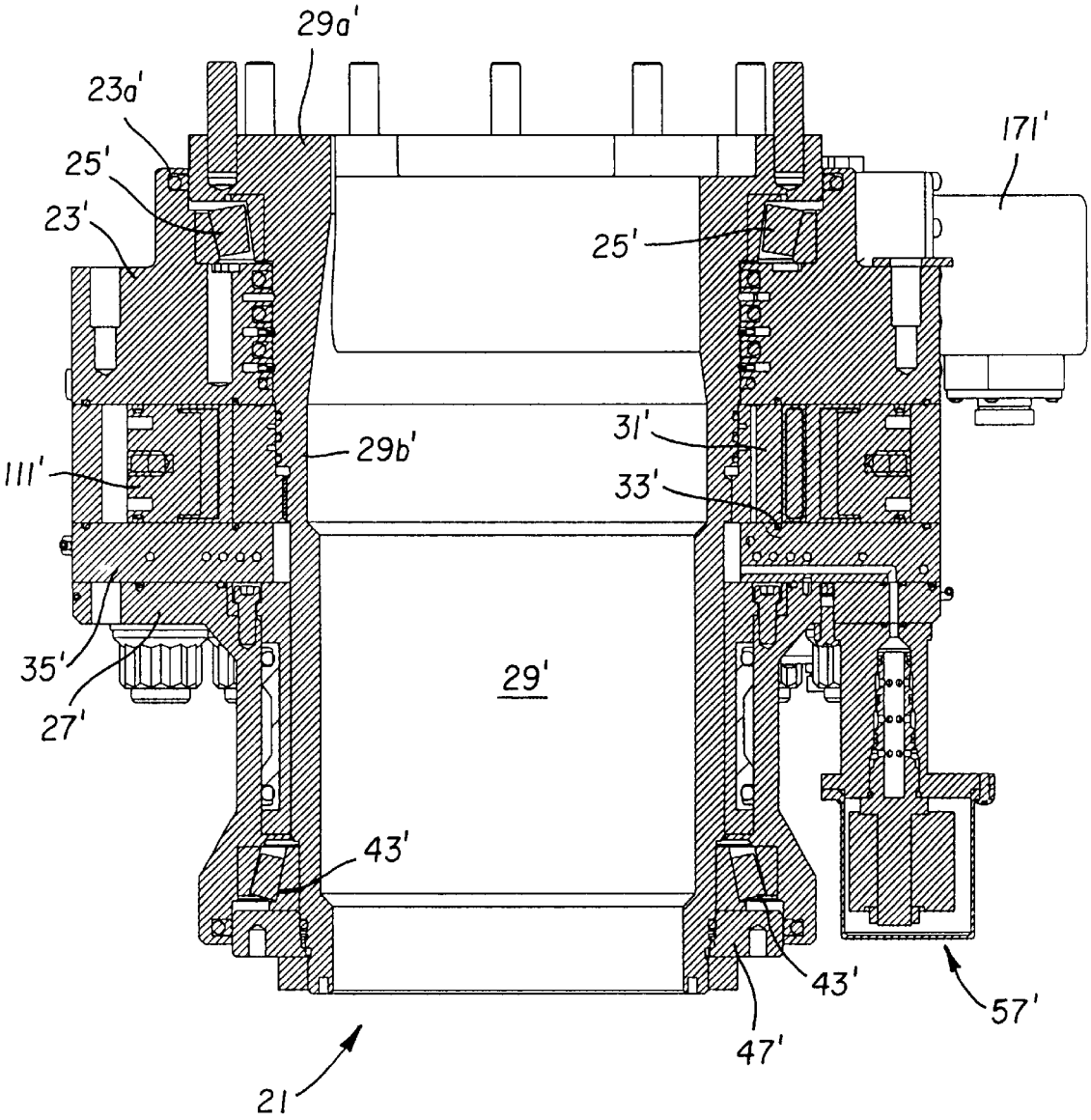
FIG. 26 is a vertical cross-sectional view of an elbow actuator according to the invention.
Figure 27:
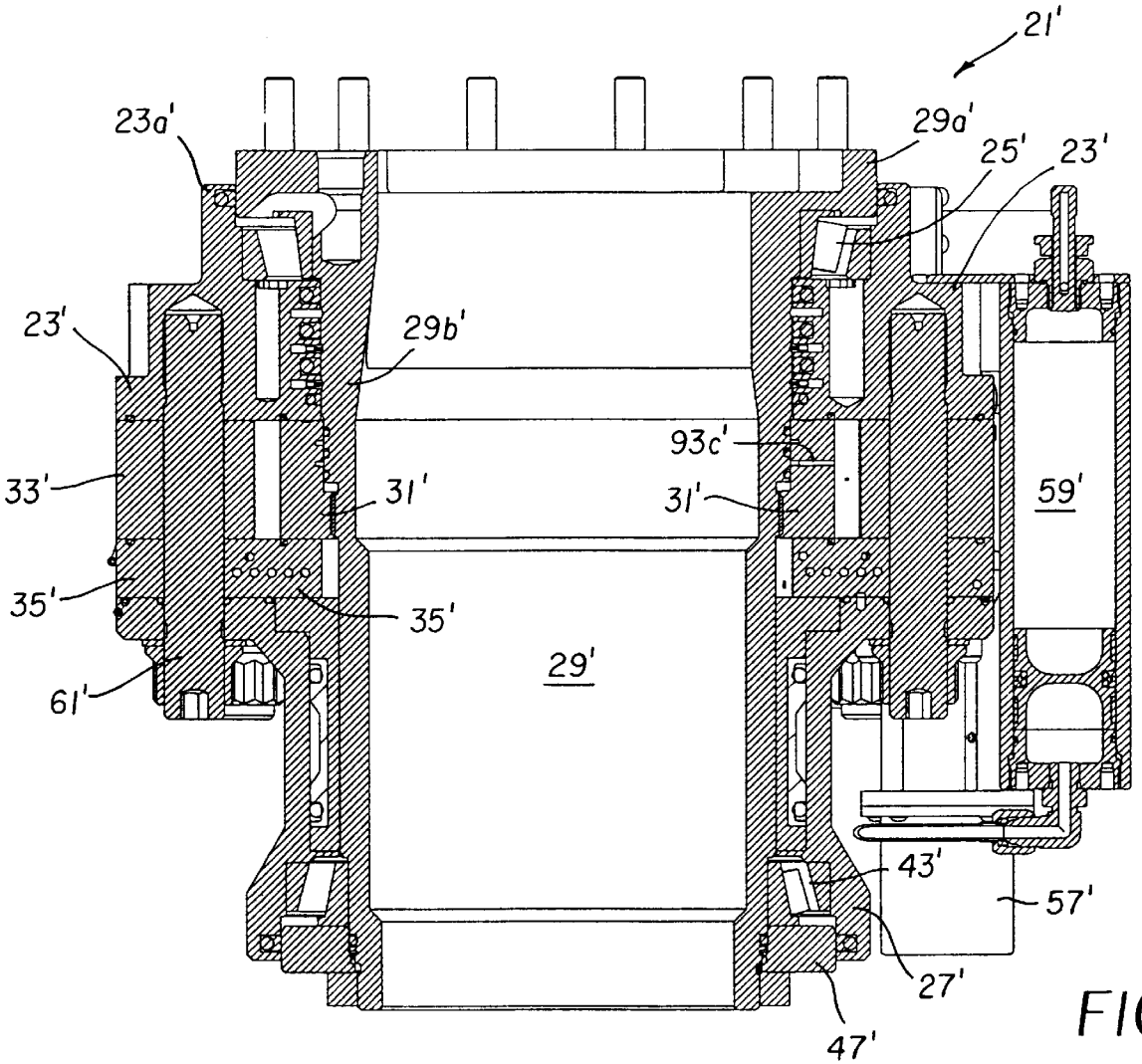
FIG. 27 is a second vertical sectional view of the elbow actuator according to the invention.

FIG. 25 is diagrammatic illustration of an alternative embodiment of a stator assembly 33' of the invention as employed in the wrist type actuator 21'. The stator assembly 33' employs a stator vane 111' movable within a stator vane pocket 81' and having a front seal 125' and a back seal 135'. In contrast to the stator vane of FIGS. 1–20, the stator vane 111' is not equipped with an intermediate flange portion.

Moreover, the stator vane 111' is not equipped with a transfer fluid passage which fluidly communicates a pressure cavity 101' with the back compartment 81*c*' of the stator vane pocket 81' so as to accommodate fluid displaced from the pressure cavity 101' as a result of the stator vane 111' being moved to a closed position whereby it engages the rotor 31'. Instead, the stator assembly 33' is equipped with a slave vane 175' and a fluid transfer circuit for each stator vane 111'. The slave vane 175' is radially movable within a slave vane pocket 177' of the stator body 33*a*' located in the vicinity of the corresponding stator vane 111'. Each slave vane 175' has front and back seals 203', 205' which seal against the slave vane pocket 81' to form a front compartment 207*a'*, an intermediate compartment 207*b*', and a back compartment 207*c'*. The fluid transfer circuit includes a front fluid passage 201' communicating the front compartment 207*a'* with the appropriate pressure cavity 101', and supply fluid passages 209' in communication with the back compartment 207*c'*. The fluid transfer circuit also has an intermediate fluid passage or slave circuit fluid passage 211' communicating the intermediate compartment 207*c'* of the slave pocket 175' with an intermediate compartment 81*b'* (not shown open in FIG. 25) of the stator vane pocket 81' that is formed when the stator vane 111' retracts from the closed position. In FIG. 25, the stator vane 111' is shown in the closed position having been thrust radially toward the rotor 31' while the slave vane 175' has retracted to an open position such that the front compartment 207*a'* is at a full volume capacity. In fact, the volume of the front compartment 207*a'* approximates the volume of fluid displaced by the stator vane 111' as the stator vane 111' moved from the open to the closed position. As the stator vane 111' retracts to the open position, fluid moves from the intermediate compartment 207*b'* of the slave vane pocket 177' to the intermediate compartment 81*b'* of the stator vane pocket 81'. Simultaneously, the slave vane pocket 177' is disposed radially inward by increasing fluid pressure in the back compartment 207*c'* of the slave vane pocket 177'. As a result, fluid from the front compartment 207*a'* moves into the pressure cavity 101'.

As the stator vane 111' is returned to its closed position, pressure is relieved from the back compartment 207*c'* of the slave vane pocket 177' at the same time that fluid is returned from the intermediate portion of the stator vane pocket 81' in the intermediate compartment 207*b'* of the slave vane pocket 177'. Moreover, fluid moves from the front compartment 207*a'* back into the pressure cavity 101 as the front compartment 207*a'* is closed by the slave vane pocket 175'.

In the above-described manner, the same type of stator balance and other attributes which characterize the stator assembly 33 of the elbow actuator 21 illustrated in FIGS. 1–20 and described above are also achieved by the design of the wrist actuator 21'. More specifically, a volume of fluid is moved or transferred back and forth between the slave vane pocket 81' and the pressure cavities 101'. This volume of fluid is approximately equal to the space occupied by the front portion of the stator vane 111' which moves radially in and out of the pressure cavities 101' and which displaces fluid therein.

The foregoing description of the present invention has been presented for purposes of illustration and description. The description is not intended to limit the invention to the form disclosed herein. Consequently, variations and modifications commensurate with the above teachings, and the skill and knowledge of the relevant art, are within the scope of the invention. The embodiments described are further intended to explain the best modes for practicing the invention, and enable others skilled in the art to utilize the invention in such, or other, embodiments and with various modifications required by the particular applications or uses of the present invention. It is intended that the appending claims be construed to include alternative embodiments to the extent that it is permitted by the prior art.

What is claimed is:

1. A rotary actuator assembly comprising:

a rotatable drive assembly having a longitudinal axis, said drive assembly including, an output shaft having a coupling end for rotatably engaging a workpiece, and a rotor disposed concentrically about said longitudinal axis and rotatable in a designated angular direction to drive rotation of said output shaft, said rotor having a rotor radial surface that includes at least one radially extending rotor vane;

a stator assembly including a stator radial surface having at least one radially extending stator vane, said stator assembly being disposed about said longitudinal axis such that said rotor and said stator assembly are positioned to form a pressure chamber defined, at least partially, by separation between said stator radial surfaces, wherein said rotor vane is substantially sealingly engaged with said stator radial surface and said stator vane is substantially sealingly engaged with said stator rotor surface to form at least a first pressure cavity of said pressure chamber and a second pressure cavity of said pressure chamber, said first and second pressure cavities being bounded, at least partially, by said rotor vane, said stator vane and said rotor and stator radial surfaces, and wherein said second pressure cavity is disposed adjacent a side of said rotor vane in the designated angular direction and said second pressure cavity is disposed adjacent a side of said rotor vane in the opposite angular direction; and a fluid pressure circuit disposed in fluid communication with said pressure chamber to produce a differential pressure acting on said rotor vane to rotatably move said output shaft assembly in the designated angular direction, such that said rotor assembly is substantially continuously movable up to about 360 degrees relative to said stator assembly;

wherein said rotor further includes a circumferentially extending groove on a surface portion of said rotor radial surface, said groove being adapted to provide a leak passage between a pressure cavity formed on one side of said stator vane when said stator vane sealingly engages said surface portion of said rotor radial surface to another pressure cavity formed on the immediate opposite side of said stator vane.

2. The actuator of claim 1, wherein said rotor is substantially continuously rotatable relative to said stator assembly beyond 360 degrees.

3. The actuator of claim 2, wherein said rotor is substantially continuously rotable relative to said stator assembly through a plurality of cycles.

4. The actuator of claim 1, wherein said stator vane assembly includes a plurality of radially movable vanes, said stator vanes being adapted to substantially sealingly engage said rotor radial surface and to form a plurality of said pressure cavities, said actuator further comprising a stator vane control circuit operable to synchronize radially reciprocating movement of said stator vanes with angular movement of said rotor.

5. The actuator of claim 4, wherein said stator vane pockets are substantially equally circumferentially spaced from one another about said longitudinal axis, said actuator further comprising a balance fluid pressure circuit in fluid communication with a predetermined number of said stator pockets and adapted to balance radial loads across said predetermined number of stator pockets.

6. The actuator of claim 1, wherein said stator assembly and said rotor are adapted such that angular movement of said rotor varies the volume of each of said first and second pressure cavities, and said fluid pressure circuit includes a first port in fluid communication with said first pressure cavity and a second port in fluid communication with said second pressure cavity, wherein said fluid pressure circuit is operable to direct fluid into said first pressure cavity through said first port and relieve fluid from said second pressure cavity through said second port.

7. A rotary actuator assembly comprising:

a rotatable drive assembly having a longitudinal axis, said drive assembly including, an output shaft having a coupling end for rotatably engaging a workpiece, and a rotor disposed concentrically about said longitudinal axis and rotatable in a designated angular direction to drive rotation of said output shaft, said rotor having a rotor radial surface that includes at least one radially extending rotor vane;

a stator assembly including a stator radial surface having at least one radially extending stator vane, said stator assembly being disposed about said longitudinal axis such that said rotor and said stator assembly are positioned to form a pressure chamber defined, at least partially, by separation between said stator radial surfaces, wherein said rotor vane is substantially sealingly engaged with said stator radial surface and said stator vane is substantially sealingly engaged with said stator rotor surface to form at least a first pressure cavity of said pressure chamber and a second pressure cavity of said pressure chamber, said first and second pressure cavities being bounded, at least partially, by said rotor vane, said stator vane and said rotor and stator radial surfaces, and wherein said second pressure cavity is disposed adjacent a side of said rotor vane in the designated angular direction and said second pressure cavity is disposed adjacent a side of said rotor vane in the opposite angular direction;

a fluid pressure circuit disposed in fluid communication with said pressure chamber to produce a differential pressure acting on said rotor vane to rotatably move said output shaft assembly in the designated angular direction, such that said rotor assembly is substantially continuously movable up to about 360 degrees relative to said stator assembly; and a stator vane control circuit operable to synchronize reciprocating radial movement of said stator vane with rotation of said rotor, such that said rotor vane is angularly movable past said stator vane and up to about 360 degrees;

wherein said stator assembly includes a stator body having at least one stator vane pocket, said stator vane pocket being configured to accommodate reciprocating radial movement of said stator vane therein;

wherein said stator vane is radially movable from said pressure chamber to allow said rotor vane to move angularly past said stator vane, said rotor vane and said stator vane being adapted to substantially sealingly engage as said rotor vane moves angularly past said stator vane; and wherein said control circuit includes a manifold body disposed concentrically about said longitudinal axis and adjacent said stator body, said manifold body including a plurality of fluid passages disposed in fluid communication with said stator vane pockets and with an external fluid pressure source.

8. The actuator of claim 7, wherein said stator vane includes a peripheral seal in sealing engagement with the inside walls of said stator pocket to form a first variable volume pressure cavity on one side of said peripheral seal and a second variable pressure cavity on the opposite side of said peripheral seal, said control circuit being disposed in fluid communication with said pressure cavities of said stator pocket and operable to produce a differential pressure across said peripheral seal, thereby effecting radial movement of said stator vane.

9. The actuator of claim 8, wherein said actuator includes a plurality of stator vane pockets, each of said pockets retaining a stator vane, said control circuit further comprising a plurality of stator vane valves, each of said stator vane valves being configured in fluid communication with one or more of said stator vane pockets such that each of said valves is operable to effect radial movement one or more of said stator vanes simultaneously.

10. The actuator of claim 9, wherein said fluid pressure circuit includes a first fluid passage positioned in fluid communication with said first pressure cavity, a second fluid passage in fluid communication with said second pressure cavity, and a servo-hydraulic control system operably connected with said first and second fluid passages; and wherein said stator vane valves are operably connected with said servo-hydraulic control system, such that operation of said control circuit is synchronized with operation of said fluid pressure circuit.

11. A rotary actuator assembly comprising:

a rotatable drive assembly having a longitudinal axis, said drive assembly including, an output shaft having a coupling end for rotatably engaging a workpiece, and a rotor disposed concentrically about said longitudinal axis and rotatable in a designated angular direction to drive rotation of said output shaft, said rotor having a rotor radial surface that includes at least one radially extending rotor vane;

a stator assembly including a stator radial surface having at least one radially extending stator vane, said stator assembly being disposed about said longitudinal axis such that said rotor and said stator assembly are positioned to form a pressure chamber defined, at least partially, by separation between said stator radial surfaces, wherein said rotor vane is substantially sealingly engaged with said stator radial surface and said stator vane is substantially sealingly engaged with said stator rotor surface to form at least a first pressure cavity of said pressure chamber and a second pressure cavity of said pressure chamber, said first and second pressure cavities being bounded, at least partially, by said rotor vane, said stator vane and said rotor and stator radial surfaces, and wherein said second pressure cavity is disposed adjacent a side of said rotor vane in the designated angular direction and said second pressure cavity is disposed adjacent a side of said rotor vane in the opposite angular direction;

a fluid pressure circuit disposed in fluid communication with said pressure chamber to produce a differential pressure acting on said rotor vane to rotatably move said output shaft assembly in the designated angular direction, such that said rotor assembly is substantially continuously movable up to about 360 degrees relative to said stator assembly;

wherein said stator assembly includes a stator body having at least one stator vane pocket, said stator vane pocket being configured to accommodate reciprocating radial movement of said stator vane therein; and wherein said stator vane is radially movable from said pressure chamber to allow said rotor vane to move angulary past said stator vane, said rotor vane and said stator vane being adapted to substantially sealingly engage as said rotor vane moves angularly past said stator vane; and a fluid transfer reservoir fluidly communicating a cavity portion of said stator pocket with a pressure cavity of said pressure chamber that is positioned immediately adjacent said stator vane when said stator vane engages a portion of said rotor radial surface other than said rotor vane.

12. The actuator of claim 11, wherein said fluid transfer reservoir includes a fluid transfer passage extending through said stator vane.

13. The actuator of claim 11, wherein said fluid transfer reservoir is sized to substantially approximate the fluid displacement volume of a front portion of said stator vane that is radially extendable into said pressure chamber to substantially sealingly engage a portion of said rotor radial surface other than said rotor vane.

14. The actuator of claim 13, wherein said stator assembly further includes a slave vane pocket and a slave vane assembly radially movable within said stator pocket in synchronization with radial movement of said stator vane, said stator pocket being disposed in fluid communication with said pressure cavity formed adjacent said stator vane.

15. A hydraulic rotary actuator assembly comprising:

a rotatable drive assembly having a longitudinal axis, said drive assembly including, an output shaft having a coupling end for rotatably engaging a workpiece, and a rotor disposed concentrically about said longitudinal axis and rotatable in a designated angular direction to drive rotation of said output shaft, said rotor having a rotor radial surface that includes a plurality of radially extending rotor vanes; and a stator assembly including a stator body with a plurality of stator vane pockets, a stator inside radial surface spaced radially outwardly from said rotor radial surface, and a plurality of radially extending stator vanes each secured in, and radially movable within, one of said stator vane pockets, wherein said stator assembly is disposed concentrically about said rotor to form a pressure chamber defined, at least partially, by separation between said stator and rotor radial surfaces, said rotor vanes being substantially sealingly engageable with said stator radial surface and said stator vanes being substantially sealingly engaged with said rotor radial surface to form a first pressure cavity of said pressure chamber and a second pressure cavity of said pressure chamber, wherein each of said first and second pressure cavities is bounded, at least partially, by said rotor vane, said stator vane and said radial surfaces of said stator assembly and said rotor, and wherein said second pressure cavity is disposed adjacent said rotor vane in the designated angular direction, and said second pressure cavity is disposed adjacent said rotor vane in the opposite angular direction;

a fluid pressure circuit in fluid communication with said first and second pressure cavities to produce a differential pressure acting on said rotor vane thereby rotatably moving said output shaft assembly; and a fluid pressure stator vane control circuit in fluid communication with said stator vane pockets, said control circuit being operable to reciprocally move said stator vanes in synchronization with operation of said fluid pressure circuit, such that each of said stator vanes retract radially as each of said rotor vanes moves angularly past said stator vane;

wherein said stator vane assembly includes:

a front portion equipped with a peripheral seal adapted to substantially seal said pressure chamber from said vane pocket, and an intermediate Hanged portion having a width dimension greater than a width dimension of said front portion, said intermediate portion being equipped with an intermediate peripheral seal for substantially sealingly engaging the inside wall of said stator vane pocket and to form an intermediate pressure cavity between said intermediate peripheral seal and said front peripheral seal, and a rear pressure cavity on the other side of said intermediate peripheral seal;

wherein said control circuit includes a first passage in communication with said intermediate pressure cavity and a second fluid passage in communication with said rear pressure cavity, said control circuit being operable to effect movement of said stator vane by communicating fluid through said first and second passages; and wherein said stator vane assembly further includes a rear peripheral seal positioned radially rearward of said intermediate peripheral seal, said real peripheral seal substantially sealingly engageable with the inside walls of said stator vane pocket to form a rearmost pressure cavity between said stator vane pocket and said stator vane, and a fluid transfer passage fluidly communicating one of said first and second pressure cavities of said pressure chamber with said rearmost pressure cavity of said stator vane pocket, such that when said stator vane moves radially forward to sealingly engage a portion of said rotor radial surface other than one of said rotor vanes, a volume of fluid is transferred from said pressure chamber into said rearmost pressure cavity.

16. The actuator of claim 15, wherein the volume capacity of said fluid transfer passage and said rearmost pressure cavity approximates the fluid displacement volume of a front portion of said stator vane assembly which extends into said pressure chamber when said stator vane sealingly engages said portion of said radial surface, and wherein said fluid transfer passage extends through said stator vane and has an opening that is closed when said stator vane is positioned in a retracted position.

17. The actuator of claim 15, wherein said front peripheral seal includes a front face portion sealingly engageable with said rotor radial surface and a second peripheral portion sealingly engageable with said stator pocket.

18. A hydraulic rotary actuator assembly comprising:

a rotatable drive assembly having a longitudinal axis, said drive assembly including, an output shaft having a coupling end for rotatably engaging a workpiece, and a rotor disposed concentrically about said longitudinal axis and rotatable in a designated angular direction to drive rotation of said output shaft, said rotor having a rotor radial surface that includes a plurality of radially extending rotor vanes; and a stator assembly including a stator body with a plurality of stator vane pockets, a stator inside radial surface spaced radially outwardly from said rotor radial surface, and a plurality of radially extending stator vanes each secured in, and radially movable within, one of said stator vane pockets, wherein said stator assembly is disposed concentrically about said rotor to form a pressure chamber defined, at least partially, by separation between said stator and rotor radial surfaces, said rotor vanes being substantially sealingly engageable with said stator radial surface and said stator vanes being substantially sealingly engaged with said rotor radial surface to form a first pressure cavity of said pressure chamber and a second pressure cavity of said pressure chamber, wherein each of said first and second pressure cavities is bounded, at least partially, by said rotor vane, said stator vane and said radial surfaces of said stator assembly and said rotor, and wherein said first pressure cavity is disposed adjacent said rotor vane in the designated angular direction, and said second pressure cavity is disposed adjacent said rotor vane in the opposite angular direction;

a fluid pressure circuit in fluid communication with said first and second pressure cavities to produce a differential pressure acting on said rotor vane thereby rotatably moving said output shaft assembly; and a fluid pressure stator vane control circuit in fluid communication with said stator vane pockets, said control circuit being operable to reciprocally move said stator vanes in synchronization with operation of said fluid pressure circuit, such that each of said stator vanes retract radially as each of said rotor vanes moves angularly past said stator vane;

wherein said stator vane assembly includes:

a front portion equipped with a peripheral seal adapted to substantially seal said pressure chamber from said vane pocket, and an intermediate flanged portion having a width dimension greater than a width dimension of said front portion, said intermediate portion being equipped with an intermediate peripheral seal for substantially sealingly engaging the inside wall of said stator vane pocket and to form an intermediate pressure cavity between said intermediate peripheral seal and said front peripheral seal, and a rear pressure cavity on the other side of said intermediate peripheral seal; wherein said control circuit includes a first passage in communication with said intermediate pressure cavity and a second fluid passage in communication with said rear pressure cavity, said control circuit being operable to effect movement of said stator vane by communicating fluid through said first and second passages: and wherein said front peripheral seal is a two-part assembly comprising an outside seal material and a seal energizing means disposed behind said outside seal material.

19. A hydraulic rotary actuator assembly comprising:

a rotatable drive assembly having a longitudinal axis, said drive assembly including, an output shaft having a coupling end for rotatably engaging a workpiece, and a rotor disposed concentrically about said longitudinal axis and rotatable in a designated angular direction to drive rotation of said output shaft, said rotor having an outside rotor radial surface that includes at least one radially extending rotor vane; and a stator assembly including an inside stator radial surface having a plurality of radially extending, radially movable stator vanes, said stator assembly being disposed concentrically about said rotor, such that said rotor and said stator assembly form a pressure chamber defined, at least partially, by separation between said rotor and stator radial surfaces, wherein said rotor vane is substantially sealingly engageable with said stator radial surface and each of said stator vanes is substantially sealingly engageable with said rotor radial surface to form at least a first pressure cavity of said pressure chamber and a second pressure cavity of said pressure chamber, said first and second pressure cavities being bounded, at least partially, by said rotor vane, said one of said stator vanes of said stator assembly and said rotor, and wherein said second pressure cavity is disposed adjacent a side of said rotor vane in the designated angular direction, and said second pressure cavity is disposed adjacent a side of said rotor vane in the opposite angular direction; and a fluid pressure circuit in fluid communication with said first and second pressure cavities to produce a differential pressure acting on said rotor vane to rotatably move said rotor and said output shaft assembly in said designated angular direction;

wherein said rotor further includes a circumferentially extending groove on a surface portion of said rotor radial surface, said groove adapted to provide a leak passage between a pressure cavity formed on one side of a stator vane that sealingly engages said portion of said rotor radial surface to another pressure cavity formed on the immediate opposite side of said stator vane.

20. The actuator of claim 19, wherein said stator assembly is adapted such that said fluid circuit is operable to effect substantially continuous rotation of said rotor in said designated angular direction beyond 360 degrees relative to said stator assembly.

21. The actuator of claim 19, wherein said stator assembly includes a stator body having a plurality of stator vane pockets, each of said stator vane pockets being configured to accommodate reciprocating radial movement of one of said stator vanes therein.

22. The actuator of claim 21, wherein each of said stator vanes are adapted to be radially movable to allow said rotor vane to move angularly past each of said stator vane during rotation of said rotor.

23. The actuator of claim 22, wherein said rotor vane and said stator are adapted to substantially sealingly engage as said rotor vane is moved angularly past said stator vane.

24. The actuator of claim 22, further comprising a fluid pressure stator vane control circuit operable to synchronize reciprocal radial movement of said stator vanes with rotation of said rotor, such that said rotor vanes angularly movable past said stator vanes.

25. The actuator of claim 24, wherein said control circuit and said fluid pressure circuit are operably connected such that radial movement of said stator vanes is synchronized with rotation of said rotor.

26. The actuator of claim 25, wherein said control circuit further includes a plurality of stator vane valves, each of said stator vane valves being configured in fluid communication with one or more of said stator vane pockets such that each of said stator vane valves is operable to effect radial movement of one or more of said stator vanes simultaneously.

27. The actuator of claim 25, wherein said fluid pressure circuit includes a first fluid passage positioned in fluid communication with said first pressure cavity, a second fluid passage in fluid communication with said second pressure cavity, and a servo-hydraulic control system operably connected with said first and second fluid passages and a fluid pressure source; and wherein said stator vane valves are operably connected with said servo-hydraulic system, such that operation of said control circuit can be synchronized with operation of said fluid pressure circuit.

28. A hydraulic rotary actuator assembly comprising:

a rotatable drive assembly having a longitudinal axis, said drive assembly including, an output shaft having a coupling end for rotatably engaging a workpiece, and a rotor disposed concentrically about said longitudinal axis and rotatable in a designated angular direction to drive rotation of said output shaft, said rotor having an outside rotor radial surface that includes at least one radially extending rotor vane; and a stator assembly including an inside stator radial surface having a plurality of radially extending, radially movable stator vanes, said stator assembly being disposed concentrically about said rotor, such that said rotor and said stator assembly form a pressure chamber defined, at least partially, by separation between said rotor and stator radial surfaces, wherein said rotor vane is substantially sealingly engageable with said stator radial surface and each of said stator vanes is substantially sealingly engageable with said rotor radial surface to form at least a first pressure cavity of said pressure chamber and a second pressure cavity of said pressure chamber, said first and second pressure cavities being bounded, at least partially, by said rotor vane, said one of said stator vanes and said radial surfaces of said stator assembly and said rotor, and wherein said second pressure cavity is disposed adjacent a side of said rotor vane in the designated angular direction, and said second pressure cavity is disposed adjacent a side of said rotor vane in the opposite angular direction;

a fluid pressure circuit in fluid communication with said first and second pressure cavities to produce a differential pressure acting on said rotor vane to rotatably move said rotor and said output shaft assembly in said designated angular direction; and a fluid transfer reservoir fluidly communicating a cavity portion of said stator pocket with a pressure cavity of said pressure chamber, said pressure cavity being formed immediately adjacent said stator vane when said stator vane engages a portion of said rotor radial surface other than one of said rotor vanes, wherein said fluid transfer reservoir includes a fluid transfer passage extending through said stator vane, said fluid transfer reservoir being sized to substantially approximate the fluid displacement volume of a front portion of said stator vane that is radially extendable into said pressure chamber to substantially sealingly engage a portion of said rotor radial surface of said rotor other than said rotor vane.

29. A method of rotatably driving an output shaft assembly of a rotary actuator, said method comprising the steps:

providing an actuator assembly including an output shaft assembly having a longitudinal axis and a coupling end adapted to rotatably engage a workpiece, and a rotor disposed about the longitudinal axis, the rotor having an outside rotor radial surface and a plurality of rotor vanes radially extending from the radial surface, a stator assembly having an inside stator radial surface and plurality of radially movable stator vanes;

securing both the stator assembly and the output shaft assembly, such that the stator assembly is positioned concentrically about the longitudinal axis and the rotor radial surface is spaced from the stator radial surface, whereby the stator vanes substantially sealingly engage the rotor radial surface and the rotor vanes substantially sealingly engage either the stator vanes or the stator radial surface to subdivide the pressure chamber into a plurality of pressure cavities, wherein each pressure cavity is bounded, at least partially, by a stator vane, a rotor vane and the radial surfaces of the rotor and the stator assembly, and wherein the pressure cavities vary in volume as the rotor moves angularly forward in the designated angular direction;

controllably applying fluid pressure to selected pressure cavities so as to provide a differential pressure across the rotor vanes, thereby angularly moving said rotor vane in the designated angular direction;

radially moving each of the stator vanes inwardly away from the longitudinal axis as each of the rotor vanes moves angularly past the stator vane, thereby allowing continuous rotation of the rotor and the output shaft beyond 360 degrees in the designated angular direction;

providing a fluid reservoir positionable in fluid communication with one of the pressure cavities;

transferring a volume of fluid from the pressure cavity to the fluid reservoir as the rotor vane moves radially into the pressure chamber after disengaging a rotor vane and to engage a portion of the rotor radial surface adjacent the rotor vane and the pressure cavity, whereby the volume of fluid transferred is substantially equal to the displacement volume of the portion of the stator vane extended into the pressure chamber; and returning the volume of fluid transferred into the fluid reservoir into the pressure chamber as the stator vane retracts before engaging a second rotor vane;

wherein the stator vane substantially sealingly engages the rotor vane as the rotor vane moves angularly past the stator vane.

30. A method of rotatably driving an output shaft assembly of a rotary actuator, said method comprising the steps:

providing an actuator assembly including a housing assembly, an output shaft assembly having a longitudinal axis and a coupling end adapted to rotatably engage a workpiece, and a rotor disposed about the longitudinal axis, the rotor having an outside rotor radial surface and a plurality of rotor vanes radially extending from the radial surface, a stator assembly having an inside stator radial surface and a plurality of radially movable stator vanes;

retaining the stator assembly and the output shaft assembly with the housing assembly, such that the stator assembly is positioned concentrically about the longitudinal axis and the rotor radial surface is spaced from the stator radial surface, whereby the stator vanes can substantially sealingly engage the rotor radial surface and the rotor vanes substantially sealingly engage either the stator vanes or the stator radial surface, to subdivide the pressure chamber into a plurality of pressure cavities, wherein each pressure cavity is bounded, at least partially, by a stator vane, a rotor vane and the radial surfaces of the rotor and the stator assembly, and wherein the pressure cavities vary in volume as the rotor moves angularly forward in the designated angular direction;

controllably applying fluid pressure to selected pressure cavities so as to produce a differential pressure across the rotor vanes, thereby effecting angular movement of the rotor and the output shaft in the designated angular direction;

radially moving the stator vanes relative to the rotor, such that the rotor vanes reciprocate radially in synchronization with angular movement of the rotor;

providing a fluid reservoir in fluid communication with one of the pressure cavities; and transferring a volume of fluid from the pressure cavity to the fluid reservoir as the stator vane extends from a radially retracted position into the pressure chamber to engage a portion of the rotor radial surface adjacent the rotor vane, whereby the volume of fluid transferred is substantially equal to the displacement volume of the portion of the stator vane extended into the pressure chamber.

31. The method of claim 30, wherein the radially moving step includes radially moving each stator vane outwardly away from the longitudinal axis as each rotor vane moves angularly past the stator vane.

32. The method of claim 31, further comprising the step of substantially sealingly engaging the stator vane with each rotor vane as each rotor vane moves past the stator vane.

33. The method of claim 30, wherein the fluid pressure applying step and the radially moving step are synchronized such that the rotor rotates substantially continuously beyond 360 degrees.

34. The method of claim 30, wherein the step of controllably applying fluid pressure includes directing fluid to a first pressure cavity adjacent one side of the rotor vane, and relieving fluid from a second pressure cavity adjacent the opposite side of the rotor vane, wherein the opposite side is in the designated angular direction from the first pressure cavity.

35. A method of rotatably driving an output shaft assembly of a rotary actuator, said method comprising the steps:

providing an actuator assembly including a housing assembly, an output shaft assembly having a longitudinal axis and a coupling end adapted to rotatably engage a workpiece, and a rotor disposed about the longitudinal axis, the rotor having an outside rotor radial surface and a plurality of rotor vanes radially extending from the radial surface, a stator assembly having an inside stator radial surface and a plurality of radially movable stator vanes;

retaining the stator assembly and the output shaft assembly with the housing assembly, such that the stator assembly is positioned concentrically about the longitudinal axis and the rotor radial surface is spaced from the stator radial surface, whereby the stator vanes can substantially sealingly engage the rotor radial surface and the rotor vanes substantially sealingly engage either the stator vanes or the stator radial surface, to subdivide the pressure chamber into a plurality of pressure cavities, wherein each pressure cavity is bounded, at least partially, by a stator vane, a rotor vane and the radial surfaces of the rotor and the stator assembly, and wherein the pressure cavities vary in volume as the rotor moves angularly forward in the designated angular direction;

controllably applying fluid pressure to selected pressure cavities so as to produce a differential pressure across the rotor vanes, thereby effecting angular movement of the rotor and the output shaft in the designated angular direction;

radially moving the stator vanes relative to the rotor, such that the rotor vanes reciprocate radially in synchronization with angular movement of the rotor;

controllably applying fluid pressure to a selected portion of one of the stator pockets so as to radially move the stator vane radially inward;

subsequently relieving fluid pressure from the selected portion of the pocket so as to allow the stator vane to retract radially;

selecting a number of the stator vanes into a first group, wherein the selected stator vanes are spaced circumferentially from one another;

wherein the step of providing a stator assembly includes providing a stator body having a plurality of stator pockets each of which is configured to accommodate reciprocating radial movement of a stator vane therein; and fluidly interconnecting the stator pockets for each of the selected stator vanes, such that each of the selected stator vanes move radially forward of radially inward together.

36. The method claim 35, further comprising the steps of:

providing a fluid pressure balancing circuit; and fluidly communicating each of the stator pockets from the selected stator vanes with the balancing circuit, such that the balancing circuit operates to balance the radial loads between each of the stator pockets for the selected stator vanes.

* * * * *

UNITED STATES PATENT AND TRADEMARK OFFICE

CERTIFICATE OF CORRECTION

PATENT NO. : 6,322,341 B1
DATED : November 27, 2001
INVENTOR(S) : John R. Haas

It is certified that error appears in the above-identified patent and that said Letters Patent is hereby corrected as shown below:

Column 1,
Line 12, under the heading "STATEMENT REGARDING FEDERALLY SPONSERED RESEARCH"

Please delete "Not Applicable." and insert -- This invention was made with Government support under Contract #NAS9-18800 awarded by National Aeronautics and Space Administration. The Government has certain rights in the invention. --

Signed and Sealed this

Fourteenth Day of May, 2002

*Attest:*

*Attesting Officer*

JAMES E. ROGAN
*Director of the United States Patent and Trademark Office*